US012798725B2

(12) United States Patent
Dupuis et al.

(10) Patent No.: US 12,798,725 B2
(45) Date of Patent: Nov. 17, 2026

(54) ADJUSTABLE SPONSON SYSTEM FOR A WATERCRAFT AND WATERCRAFT HAVING SAME

(71) Applicant: BOMBARDIER RECREATIONAL PRODUCTS INC., Valcourt (CA)

(72) Inventors: Felix Dupuis, Windsor (CA); Antoine Labbe, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 56 days.

(21) Appl. No.: 18/870,035

(22) PCT Filed: May 30, 2023

(86) PCT No.: PCT/IB2023/055537

§ 371 (c)(1),
(2) Date: Nov. 27, 2024

(87) PCT Pub. No.: WO2023/233294

PCT Pub. Date: Dec. 7, 2023

(65) Prior Publication Data

US 2025/0333138 A1 Oct. 30, 2025

Related U.S. Application Data

(60) Provisional application No. 63/347,369, filed on May 31, 2022.

(51) Int. Cl.
*B63B 1/22* (2006.01)
*B63B 1/18* (2006.01)
(Continued)

(52) U.S. Cl.
CPC ..... *B63B 1/22* (2013.01); *B63B 34/10* (2020.02); *B63B 39/061* (2013.01); *B63B 2001/186* (2013.01)

(58) Field of Classification Search
CPC ..... B63B 2001/045; B63B 2001/183; B63B 2001/186; B63B 2001/201; B63B 1/22;
(Continued)

(56) References Cited

U.S. PATENT DOCUMENTS 5,713,297 A 2/1998 Tani et al.
5,908,006 A 6/1999 Ibata
(Continued)

OTHER PUBLICATIONS

The Watercraft Journal; https://watercraftjournal.com/gallery-understanding-fluid-dynamics-in-relation-to-superior-sponson-design/ ; retrieved from the internet on Nov. 27, 2024.

*Primary Examiner* — Ajay Vasudeva
(74) *Attorney, Agent, or Firm* — BCF LLP

(57) ABSTRACT

A watercraft has left and right sponsons movable between raised and lowered positions. For each sponson, an actuatable anchor connects the sponson to a hull of the watercraft; and a guiding slot guides movement of the sponson. The actuatable anchor is received in the guiding slot. The sponson is in the raised position when the actuatable anchor is at a first location of the guiding slot, and in the lowered position when the actuatable anchor is at a second location of the guiding slot. The guiding slot has recessed portions at the first and second locations that are shaped and sized to prevent the actuatable anchor from moving relative to the guiding slot when a handle of the actuatable anchor is received therein and is in the locked position. The actuatable anchor is movable from the first and second locations when the handle is in the unlocked position.

19 Claims, 16 Drawing Sheets

(51) Int. Cl.
*B63B 34/10* (2020.01)
*B63B 39/06* (2006.01)

(58) Field of Classification Search
CPC ..... B63B 39/061; B63B 39/062; B63B 2039/063; B63B 2039/065; B63B 34/10
See application file for complete search history.

(56) References Cited

U.S. PATENT DOCUMENTS

| | | | |
|---|---|---|---|
| 6,032,605 | A | 3/2000 | Takashima |
| 6,041,727 | A | 3/2000 | Yamada et al. |
| 6,058,873 | A | 5/2000 | Koyanagi |
| 6,523,490 | B1 | 2/2003 | Watkins |
| 6,546,888 | B2 | 4/2003 | Bertrand et al. |
| 6,651,579 | B1 | 11/2003 | Wynne et al. |
| 6,675,732 | B2 | 1/2004 | Orr |
| 6,712,016 | B1 | 3/2004 | Morisch et al. |
| 6,807,920 | B1 | 10/2004 | Wynne |
| 6,827,031 | B2 | 12/2004 | Aoyama |
| 7,168,386 | B2 | 1/2007 | Kochi et al. |
| 8,393,287 | B2 | 3/2013 | Spade et al. |
| 8,485,115 | B2 | 7/2013 | Spade et al. |
| 12,534,161 | B2 * | 1/2026 | Miwa ..... B63B 1/26 |
| 2003/0075094 | A1 | 4/2003 | Aoyama |
| 2012/0132125 | A1 | 5/2012 | Spade |

* cited by examiner

ADJUSTABLE SPONSON SYSTEM FOR A WATERCRAFT AND WATERCRAFT HAVING SAME

CROSS-REFERENCE

The present application claims priority to U.S. Provisional Patent Application No. 63/347,369, filed May 31, 2022, the entirety of which is incorporated herein by reference.

TECHNICAL FIELD

The present invention relates to sponsons for watercraft, and specifically to sponsons that are adjustable to selectively change their positions.

BACKGROUND

A hull of a watercraft such as that of a personal watercraft (PWC) supports the watercraft in the water and is formed to have a particular shape which imparts to the watercraft certain handling characteristics. Sponsons are also sometimes connected to the hull to modify the handling characteristics of the watercraft. In particular, the sponsons can modify the manner in which the watercraft turns and the amount of lift provided to the watercraft.

In some high-performance PWCs, the position of each sponson is adjustable to modify the effect that the sponsons have on the handling characteristics of the PWC. In particular, the sponsons can be adjusted to make the handling of the PWC sportier. However, the adjustment of the positions of the sponsons can take time, and/or be limited in its effect on the handling characteristics of the watercraft.

In view of the foregoing, there is a need for an adjustable sponson system for a watercraft which addresses at least in part some of these defects.

SUMMARY

It is an object of the present invention to ameliorate at least some of the inconveniences present in the prior art.

According to one aspect of the present technology, there is provided a watercraft comprising: a deck; a hull supporting the deck; left and right sponsons movably connected to the hull and disposed on opposite sides of a longitudinal centerplane of the watercraft, each sponson of the left and right sponsons being movable between a raised position and a lowered position; for each sponson of the left and right sponsons: an actuatable anchor connecting the sponson to the hull, the actuatable anchor selectively securing the sponson in the raised position and in the lowered position, the actuatable anchor comprising a handle that is movable between a locked position and an unlocked position, the handle being biased toward the locked position; and a guiding slot defined by one of the hull and the sponson for guiding movement of the sponson between the raised position and the lowered position, the actuatable anchor being received in the guiding slot, the actuatable anchor being movable relative to the guiding slot between a first location and a second location of the guiding slot, the sponson being in the raised position when the actuatable anchor is moved relative to the guiding slot to the first location, the sponson being in the lowered position when the actuatable anchor is moved relative to the guiding slot to the second location, the guiding slot having a first recessed portion at the first location and a second recessed portion at the second location, the first and second recessed portions being configured to receive the handle of the actuatable anchor, the first and second recessed portions being shaped and sized to prevent the actuatable anchor from moving relative to the guiding slot from the first and second locations when the handle is received therein and is in the locked position, the actuatable anchor being movable relative to the guiding slot from the first location and the second location when the handle is in the unlocked position.

In some embodiments, for each sponson of the left and right sponsons: the guiding slot is defined by the sponson; and the actuatable anchor is connected to the hull.

In some embodiments, for each sponson of the left and right sponsons, the sponson is translatable between the raised position and the lowered position.

In some embodiments, the guiding slot is a main guiding slot, the watercraft further comprising for each sponson of the left and right sponsons: at least one additional anchor connecting the sponson to the hull; and at least one additional guiding slot defined by the one of the hull and the sponson, the at least one additional anchor being received in the at least one additional guiding slot, the at least one additional anchor being movable relative to the at least one additional guiding slot between first and second locations of the at least one additional guiding slot, the sponson being in the raised position when the actuatable anchor is in the first location of the main guiding slot and the at least one additional anchor is in the first location of the at least one additional guiding slot, the sponson being in the lowered position when the actuatable anchor is in the second location of the main guiding slot and the at least one additional anchor is in the second location of the at least one additional guiding slot.

In some embodiments, the at least one additional anchor includes two additional anchors, the actuatable anchor being disposed between the two additional anchors in a longitudinal direction of the watercraft.

In some embodiments, the at least one additional anchor comprises a fastener comprising a shank and a head; and the at least one additional guiding slot defines a head-receiving recess and an opening in communication with the head-receiving recess, the head-receiving recess and the opening respectively receiving the head and the shank of the fastener of the at least one additional anchor.

In some embodiments, the head-receiving recess extends from the first location to the second location of the at least one additional guiding slot.

In some embodiments, the at least one additional anchor further comprises a spacer disposed between the sponson and the hull.

In some embodiments, the actuatable anchor further comprises: a fastener defining an axis; and a spring surrounding part of the fastener for biasing the handle toward the locked position, the handle defining a handle recess at least partially receiving the fastener, the handle being movable along the axis of the fastener between the locked position and the unlocked position.

In some embodiments, the guiding slot is generally L-shaped such that the actuatable anchor describes a generally L-shaped path in moving relative to the guiding slot between the first and second locations thereof.

In some embodiments, the guiding slot extends vertically upward from the first location and then forward to the second location.

In some embodiments, the hull comprises left and right chines; for each sponson of the left and right sponsons: the sponson extends generally vertically, the sponson having a width measured laterally and a height measured vertically;

the height of the sponson is greater than the width of the sponson; in the lowered position, the sponson is disposed adjacent to a corresponding chine of the left and right chines.

In some embodiments, for each sponson of the left and right sponsons, a ratio of the height of the sponson over the width of the sponson is between 2 and 5 inclusively.

In some embodiments, the ratio of the height of the sponson over the width of the sponson is between 3 and 5 inclusively.

In some embodiments, for each sponson of the left and right sponsons: the sponson comprises an upper portion that is connected to the hull and a lower portion that flares laterally outwardly from the upper portion; and the upper portion is a part of the sponson that is closest to the longitudinal centerplane of the watercraft.

In some embodiments, the hull comprises a left upwardly-extending wall that extends upwardly from the left chine and a right upwardly-extending wall that extends upwardly form the right chine; for each sponson of the left and right sponsons: the sponson comprises an outer surface and an inner surface, the inner surface facing laterally inwardly toward the longitudinal centerplane of the watercraft, the sponson being connected to a corresponding one of the left and right upwardly-extending walls of the hull; in the raised position of the sponson: a lower end of the sponson is disposed higher than a corresponding one of the left and right chines on same side of the longitudinal centerplane of the watercraft; and the inner surface of the sponson is spaced from the corresponding one of the left and right upwardly-extending walls by a first distance to define a gap between the corresponding one of the upwardly-extending walls and the inner surface; and in the lowered position of the sponson: the lower end of the sponson is disposed lower than the corresponding one of the left and right chines on the same side of the longitudinal centerplane of the watercraft; and a portion of the inner surface of the sponson that is aligned with the corresponding one of the left and right upwardly-extending walls in a height direction of the watercraft is: mated with the corresponding one of the left and right upwardly-extending walls such that the inner surface is in contact with the corresponding one of the left and right upwardly-extending walls; or spaced from the corresponding one of the left and right upwardly-extending walls by a second distance smaller than the first distance to define a reduced gap between the corresponding one of the left and right upwardly-extending walls and the inner surface.

In some embodiments, the hull further comprises: a left inwardly-extending surface that extends laterally inwardly from the left chine; and a right inwardly-extending surface that extends laterally inwardly from the right chine, the left and right inwardly-extending surfaces being generally perpendicular to the longitudinal centerplane of the watercraft.

In some embodiments, the left and right chines are first left and right chines; and the hull further comprises a second left chine and a second right chine disposed lower than the first left and right chines respectively along the height direction of the watercraft.

According to another aspect of the present technology, there is provided an adjustable sponson system for a watercraft, comprising: left and right sponsons configured to be movably connected to a hull of the watercraft, each sponson of the left and right sponsons being configured to be moved relative to the hull between a raised position and a lowered position, each sponson of the left and right sponsons defining a guiding slot for guiding movement of the sponson between the raised position and the lowered position; and for each sponson of the left 20 and right sponsons: an actuatable anchor configured to connect the sponson to the hull, the actuatable anchor selectively securing the sponson in the raised position and in the lowered position, the actuatable anchor comprising a handle that is movable between a locked position and an unlocked position, the handle being biased toward the locked position, the actuatable anchor being received in the guiding slot, the actuatable anchor being movable relative to the guiding slot between a first location and a second location of the guiding slot, the sponson being configured to be in the raised position when the actuatable anchors is moved relative to the guiding slot to the first locations of the guiding slot, the sponson being configured to be in the lowered position when the anchor is moved relative to the guiding slot to the second location of the guiding slot, the guiding slot having a first recessed portion at the first location and a second recessed portion at the second location, the first and second recessed portions being configured to receive the handle of the actuatable anchor, the first and second recessed portions being shaped and sized to prevent the actuatable anchor from moving relative to the guiding slot from the first and second locations when the handle is received therein and is in the locked position, the actuatable anchor being movable relative to the guiding slot from the first location and the second location when the handle is in the unlocked position.

According to another aspect of the present technology, there is provided a watercraft comprising: a deck; a hull supporting the deck, the hull comprising left and right chines disposed on opposite sides of a longitudinal centerplane of the watercraft; and left and right sponsons movably connected to the hull, each sponson of the left and right sponsons being movable between a raised position and a lowered position, for each sponson of the left and right sponsons: the sponson extending generally vertically, the sponson having a width measured laterally and a height measured vertically, the height of the sponson being greater than the width of the sponson, wherein, in the lowered position of the sponson: a lower end of the sponson is disposed lower than a corresponding one of the left and right chines on the same side of the longitudinal centerplane of the watercraft such that, in response to the watercraft turning, the sponson is configured to cut into the water to decrease a turning radius of the watercraft, and in the raised position of the sponson: the lower end of the sponson is disposed higher than the corresponding one of the left and right chines on the same side of the longitudinal centerplane of the watercraft such that, in response to the watercraft turning, the sponson is configured not to engage the water sufficiently to affect the turning radius of the watercraft.

In some embodiments, the watercraft further comprises, for each sponson of the left and right sponsons: at least one anchor connecting the sponson to the hull; and at least one guiding slot defined by one of the hull and the sponson for guiding movement of the sponson between the raised position and the lowered position, each anchor of the at least one anchor being received in a corresponding one of the at least one guiding slot, each anchor of the at least one anchor being movable relative to the corresponding one of the at least one guiding slot between a first location and a second location of the corresponding one of the at least one guiding slot, the sponson being in the raised position when the at least one anchor is moved to the first location of the at least one guiding slot, the sponson being in the lowered position when the at least one anchor is moved to the second location of the at least one guiding slot.

In some embodiments, for each sponson of the left and right sponsons: the at least one anchor includes an actuatable anchor that selectively secures the sponson in the raised position and in the lowered position, the actuatable anchor comprising a handle that is movable between a locked position and an unlocked position, the handle being biased toward the locked position; the at least one guiding slot includes a main guiding slot along which the actuatable anchor is movable, the main guiding slot having a first recessed portion at the first location and a second recessed portion at the second location, the first and second recessed portions being configured to receive the handle of the actuatable anchor; the first and second recessed portions are shaped and sized to prevent the actuatable anchor from moving relative to the main guiding slot from the first and second locations when the handle is received therein and is in the locked position; the actuatable anchor is movable relative to the main guiding slot from the first location and the second location when the handle is in the unlocked position.

In some embodiments, the at least one anchor includes three anchors including: a first end anchor; a second end anchor; and the actuatable anchor disposed between the first and second end anchors in a longitudinal direction of the watercraft.

In some embodiments, the at least one anchor includes the actuatable anchor and at least one additional anchor; the at least one guiding slot includes the main guiding slot and at least one additional guiding slot; the at least one additional anchor is received in the at least one additional guiding slot; the at least one additional anchor comprises a fastener comprising a shank and a head; and the at least one additional guiding slot defines a head-receiving recess and an opening in communication with the head-receiving recess, the head-receiving recess and the opening respectively receiving the head and the shank of the at least one additional anchor.

In some embodiments, the head-receiving recess extends from the first location to the second location of the at least one additional guiding slot.

In some embodiments, the at least one additional anchor further comprises a spacer disposed between the sponson and the hull.

In some embodiments, the actuatable anchor further comprises: a fastener defining an axis; and a spring surrounding part of the fastener for biasing the handle toward the locked position, the handle defining a handle recess at least partially receiving the fastener, the handle being movable along the axis of the fastener between the locked position and the unlocked position.

In some embodiments, the at least one guiding slot is generally L-shaped such that the at least one anchor describes a generally L-shaped path in moving relative to the at least one guiding slot between the first and second locations thereof.

In some embodiments, the at least one guiding slot extends vertically upward from the first location and then forward to the second location.

In some embodiments, for each sponson of the left and right sponsons: the at least one guiding slot is defined by the sponson; and the at least one anchor is connected to the hull.

In some embodiments, for each sponson of the left and right sponsons, a ratio of the height of the sponson over the width of the sponson is between 2 and 5 inclusively.

In some embodiments, the ratio of the height of the sponson over the width of the sponson is between 3 and 5 inclusively.

In some embodiments, for each sponson of the left and right sponsons: the sponson comprises an upper portion that is connected to the hull and a lower portion that flares laterally outwardly from the upper portion; and the upper portion is a part of the sponson that is closest to the longitudinal centerplane of the watercraft.

In some embodiments, the hull comprises a left upwardly-extending wall that extends upwardly from the left chine and a right upwardly-extending wall that extends upwardly from the right chine; for each sponson of the left and right sponsons: the sponson comprises an outer surface and an inner surface, the inner surface facing laterally inwardly toward the longitudinal centerplane of the watercraft, the sponson being connected to a corresponding one of the left and right upwardly-extending walls of the hull; in the raised position of the sponson: the inner surface of the sponson is spaced from the corresponding one of the left and right upwardly-extending walls by a first distance to define a gap between the corresponding one of the left and right upwardly-extending walls and the inner surface; and in the lowered position of the sponson: a portion of the inner surface of the sponson that is aligned with the corresponding one of the left and right upwardly-extending walls in a height direction of the watercraft is: mated with the corresponding one of the left and right upwardly-extending walls such that the inner surface is in contact with the corresponding one of the left and right upwardly-extending walls; or spaced from the corresponding one of the left and right upwardly-extending walls by a second distance smaller than the first distance to define a reduced gap between the corresponding one of the left and right upwardly-extending walls and the inner surface.

For purposes of this application, the terms related to spatial orientation such as forwardly, rearward, left and right, are as they would normally be understood by an operator of a vehicle sitting thereon in a normal driving position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
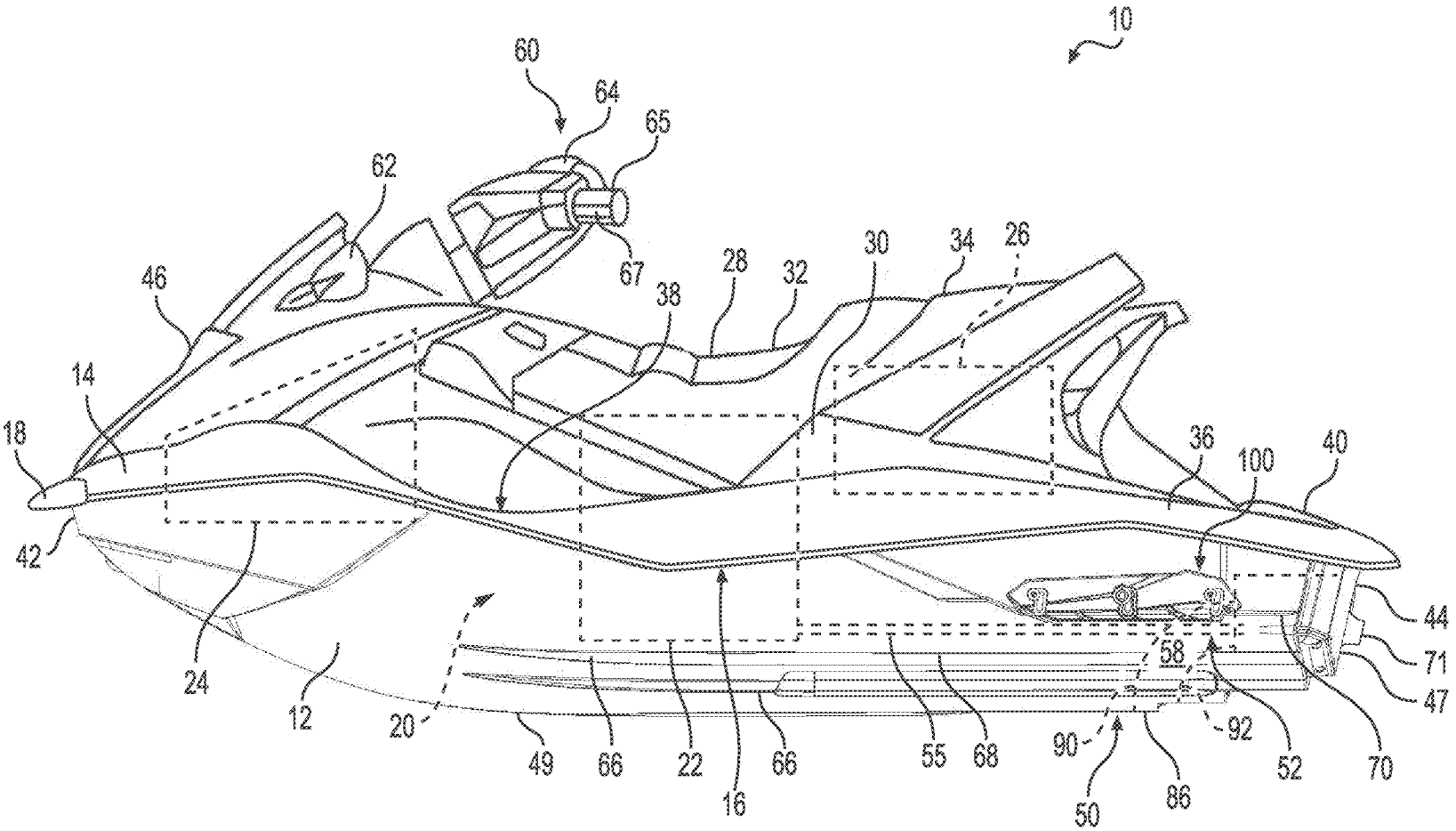
FIG. 1 is a left side elevation view of a personal watercraft in accordance with an embodiment of the present technology.

FIG. 1 shows a watercraft 10 provided with a pair of sponsons 100 (only one of which is shown in FIG. 1) in accordance with one embodiment of the present technology. In this embodiment, the watercraft 10 is a personal watercraft (PWC). It is contemplated that the watercraft 10 may be any other suitable type of watercraft in other embodiments. The sponsons 100 are adjustable to modify their effect on the behaviour of the watercraft 10, namely during turning thereof. Moreover, as will be described in greater detail further below, the sponsons 100 can be raised or lowered with relative ease to modulate the turning behavior of the watercraft 10.

The watercraft 10 will now be generally described with reference to FIGS. 1 and 2. The watercraft 10 has a hull 12 and a deck 14 supported by the hull 12. The hull 12 buoyantly supports the watercraft 10 in the water. The deck 14 is designed to accommodate one or multiple riders. The hull 12 and the deck 14 are joined together at a seam 16 that joins the parts in a sealing relationship. A bumper 18 generally covers the seam 16, which helps to prevent damage to the outer surface of the watercraft 10 when the watercraft 10 is docked, for example.

The hull 12 defines a bow 42 and a stern 44 opposite the bow 42, as well as a laterally centered keel 49. The hull 12 also has strakes 66 and chines 68, 70 on each lateral side thereof. A strake 66 is a protruding portion of the hull 12. The chines 68, 70 are the vertices formed where two surfaces of the hull 12 meet. The combination of strakes 66 and chines 68, 70 provide the watercraft 10 with some of its riding and handling characteristics.

In this embodiment, the hull 12 has a lower chine 68 and an upper chine 70 on each lateral side of the hull 12 (i.e., left lower and upper chines 68, 70 and right lower and upper chines 68, 70). Left and right upwardly-extending surfaces 75 (one of which is shown in FIG. 1) extend upwardly from the left and right upper chines 70 respectively towards an upper end 35 of the hull 12. It is contemplated that the lower chines 68 could be omitted in other embodiments.

The deck 14 has a centrally positioned straddle-type seat 28 positioned on top of a pedestal 30 to accommodate multiple riders in a straddling position. The seat 28 includes a front seat portion 32 and a rear, raised seat portion 34. The seat 28 is preferably made as a cushioned or padded unit, or as interfitting units. The front and rear seat portions 32, 34 are removably attached to the pedestal 30. The seat portions 32, 34 can be individually tilted or removed completely. Seat portion 32 covers a motor access opening defined by a top portion of the pedestal 30 to provide access to a motor 22 (shown schematically in FIG. 1). Seat portion 34 covers a removable storage bin 26 (shown schematically in FIG. 1).

The watercraft 10 has a pair of generally upwardly extending walls located on either side of the watercraft 10 known as gunwales or gunnels 36. The gunnels 36 help to prevent the entry of water in footrests 38 of the watercraft 10, provide lateral support for the riders' feet, and also provide buoyancy when turning the watercraft 10, since the personal watercraft 10 rolls slightly when turning. Towards the rear of the watercraft 10, the gunnels 36 extend inwardly to act as heel rests 45 (FIG. 2). A passenger riding the watercraft 10 facing towards the rear, to spot a water-skier for example, may place his or her heels on the heel rests 45, thereby providing a more stable riding position. Heel rests could also be formed separately from the gunnels 36.

Located on both sides of the watercraft 10, between the pedestal 30 and the gunnels 36, are the left and right footrests 38 which are disposed on opposite sides of a longitudinal centerplane 19 (FIG. 2) of the watercraft 10 that bisects a width thereof. The footrests 38 are designed to accommodate the riders' feet in various riding positions. The footrests 38 are covered by carpeting made of a rubber-type material, for example, to provide additional comfort and traction for the feet of the riders.

A reboarding platform 40 is provided at the rear of the watercraft 10 on the deck 14 to allow the rider or a passenger to easily reboard the watercraft 10 from the water. Nonslip mats or some other suitable covering may cover the reboarding platform 40. A retractable ladder (not shown) may be affixed to a transom 47 of the stern 44 to facilitate boarding the watercraft 10 from the water onto the reboarding platform 40.

As seen in FIG. 1, the watercraft 10 is provided with a hood 46 located forwardly of the seat 28 and a helm assembly 60. A hinge (not shown) is attached between a forward portion of the hood 46 and the deck 14 to allow the hood 46 to move to an open position to provide access to a front storage bin 24. A latch (not shown) located at a rearward portion of the hood 46 locks the hood 46 into a closed position. When in the closed position, the hood 46 prevents water from entering the front storage bin 24. Rearview mirrors 62 (FIG. 2) are positioned on either side of the hood 46 to allow the rider to see behind the watercraft 10. A hook 59 (FIG. 4) is located at the bow 42 of the watercraft 10 (FIG. 2). The hook 59 is used to attach the watercraft 10 to a dock when the watercraft 10 is not in use or to attach to a winch when loading the watercraft 10 on a trailer, for instance.

Figure 2:
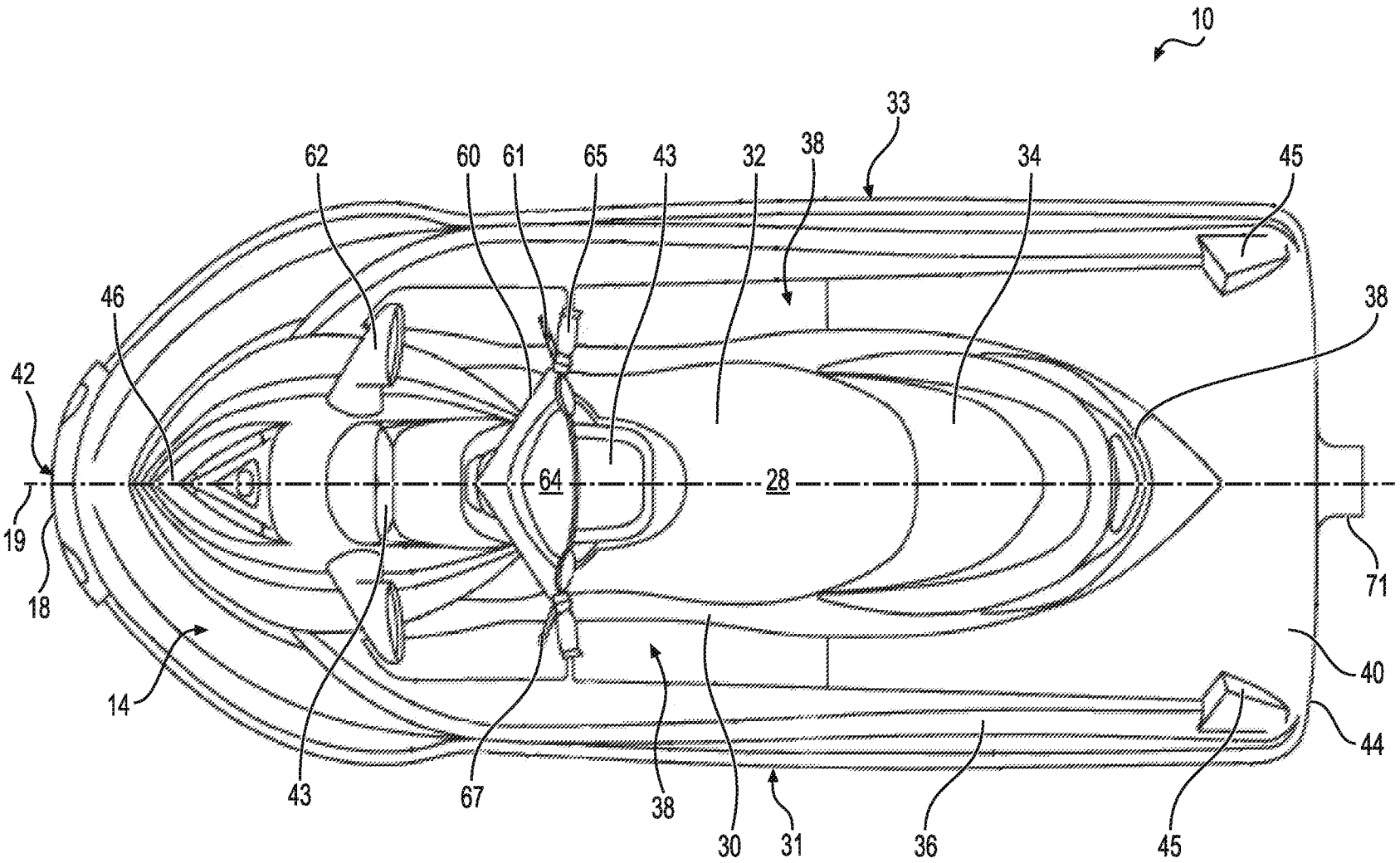
FIG. 2 is a top plan view of the watercraft of FIG. 1.
Figure 3:
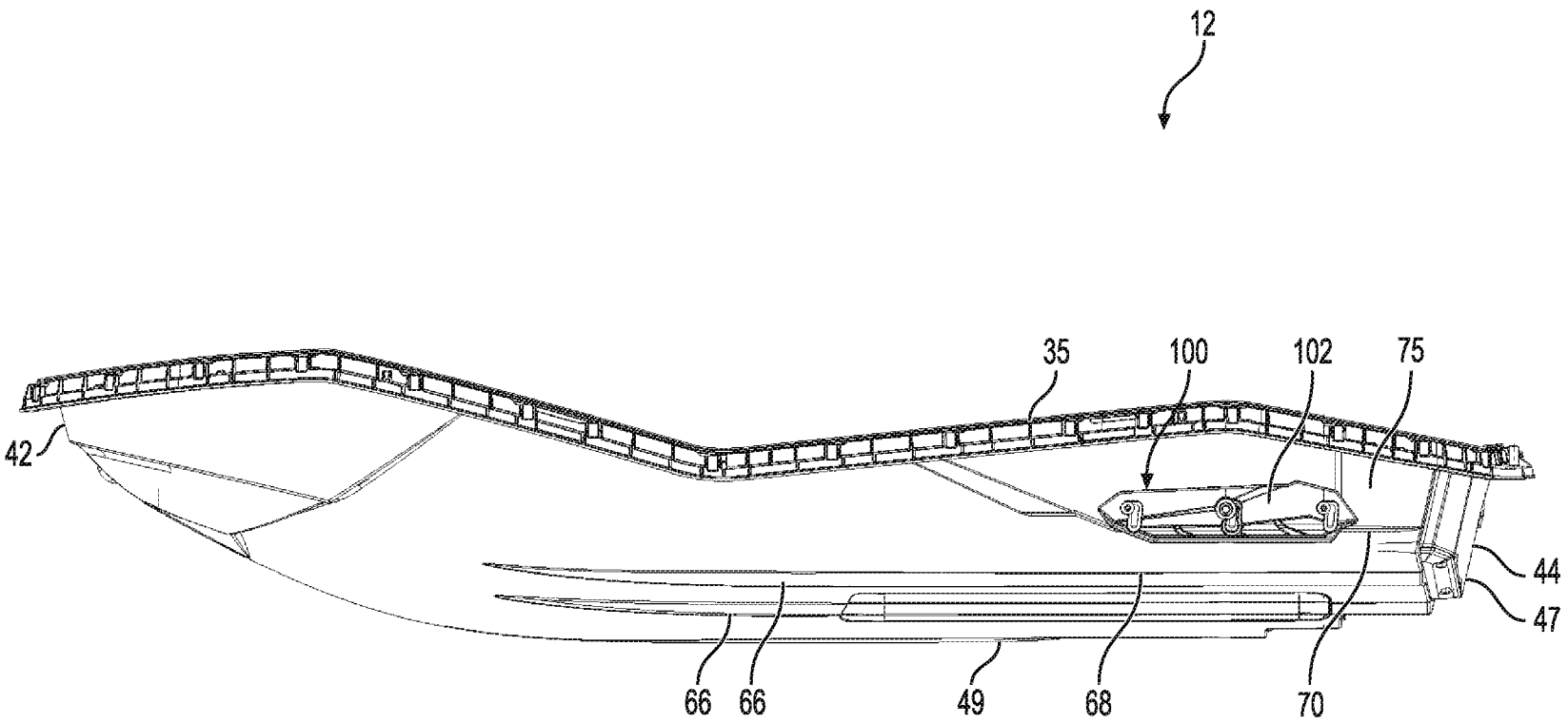
FIG. 3 is a left side elevation view of a hull and an adjustable sponson system of the watercraft of FIG. 1.

As best seen in FIG. 2, the helm assembly 60 is positioned forwardly of the seat 28. The helm assembly 60 has a central helm portion 64, that is padded, and a pair of steering handles 65, also referred to as a handlebar. One of the steering handles 65 is provided with a throttle operator 61, which allows the rider to control the motor 22, and therefore the speed of the watercraft 10. The throttle operator 61 is a finger-actuated throttle lever. However, it is contemplated that the throttle operator 61 could take other forms, such as a thumb-actuated throttle lever or a twist grip. The throttle operator 61 is movable between an idle position and multiple actuated positions. In this embodiment, the throttle operator 61 is biased towards the idle position, such that, should the driver of the watercraft 10 let go of the throttle operator 61, it will move to the idle position. The other of the steering handles 65 is provided with a reverse gate operator 67 used by the driver to actuate a reverse gate (not shown) of the watercraft 10. The reverse gate operator 67 is a finger-actuated lever. However, it is contemplated that the reverse gate operator 67 could be a thumb-actuated lever or a twist grip.

The helm assembly 60 is provided with a key receiving post (not shown) located near a center of the central helm portion 64. The key receiving post is adapted to receive a key that starts the watercraft 10. It should be noted that the key receiving post may be placed in any suitable location on the watercraft 10.

As shown in FIG. 2, a display area or cluster 43 is located forwardly of the helm assembly 60. The display cluster 43 can be of any conventional display type, including a liquid crystal display (LCD), dials or LED (light emitting diodes). The central helm portion 64 has various buttons, which could alternatively be in the form of levers or switches, that allow the driver to modify the display data or mode (speed, engine rpm, time, etc.) on the display cluster 43 or to change a condition of the watercraft 10, such as trim (the pitch of the watercraft 10).

With reference to FIG. 1, the motor 22 is supported by the hull 12 and is enclosed within a motor compartment 20 defined between the hull 12 and the deck 14. The motor 22 is configured for driving a jet propulsion system 50 (also commonly referred to as a "jet pump drive") which propels the watercraft 10. The motor compartment 20 accommodates the motor 22, as well as a muffler, gas tank, electrical system (battery, electronic control unit, etc.), air box, storage bins 24, 26, and other elements required or desirable in the watercraft 10. In this embodiment, the motor 22 is an internal combustion engine 22 and will thus be referred to as the engine 22. However, it is contemplated that, in alternative embodiments, the motor 22 may be any other suitable type of motor such as an electric motor. As will be understood, in such an embodiment, certain components would be added to or omitted from the watercraft 10 (e.g., no muffler and gas tank, etc.).

As mentioned above, the watercraft 10 is propelled by the jet propulsion system 50 which pressurizes water to create thrust. To that end, the jet propulsion system 50 has a duct 52 (FIG. 1) in which water is pressurized and which is defined by various components of the jet propulsion system 50, including an intake ramp 58, an impeller housing (not shown), and a steering nozzle 71 of the jet propulsion system 50. A driveshaft 55 is connected between the engine 22 and an impeller (not shown) of the jet propulsion system 50. A bellow assembly (not shown) is mounted to the driveshaft 55 and provides a seal between the duct 52 and the hull 12 such as to prevent entry of water into the hull 12.

The duct 52 has an inlet 86 positioned under the hull 12. When the jet propulsion system 50 is in operation, water is first scooped into the inlet 86. An inlet grate (not shown) is positioned adjacent (i.e., at or near to) the inlet 86 and is configured to prevent large rocks, weeds, and other debris from entering the jet propulsion system 50, which may damage the system or negatively affect performance. It is contemplated that the inlet grate could be positioned in the inlet 86. Water flows from the inlet 86 through the intake ramp 58. The intake ramp 58 has a top portion 90 that is formed by the hull 12 and a bottom portion 92 that is formed by a ride shoe (not shown).

The watercraft 10 is also provided with a reverse gate (not shown) which is movable between a stowed position where it does not interfere with the jet of water being expelled rearwardly along the duct 52 by the jet propulsion system 50 and a plurality of positions where it redirects the jet of water being expelled rearwardly along the duct 52 by the jet propulsion system 50. Notably, the reverse gate can be actuated into a neutral position in which the thrust generated by the jet propulsion system 50 does not have a horizontal component such that the watercraft 10 will not be accelerated or decelerated by the thrust and will stay in position if it was not moving prior to moving the reverse gate in the neutral position. The reverse gate can also be actuated into a reverse position as it redirects the jet of water towards the front of the watercraft 10, thus causing the watercraft 10 to move in a reverse direction. A reverse gate actuator (not shown), in the form of an electric motor, is operatively connected to the reverse gate to move the reverse gate. The reverse gate actuator could alternatively be any one of a mechanical, a hydraulic, or another type of electric actuator.

The watercraft 10 also has other features and characteristics that are commonly known in the art and will therefore not be described herein.

Figure 4:
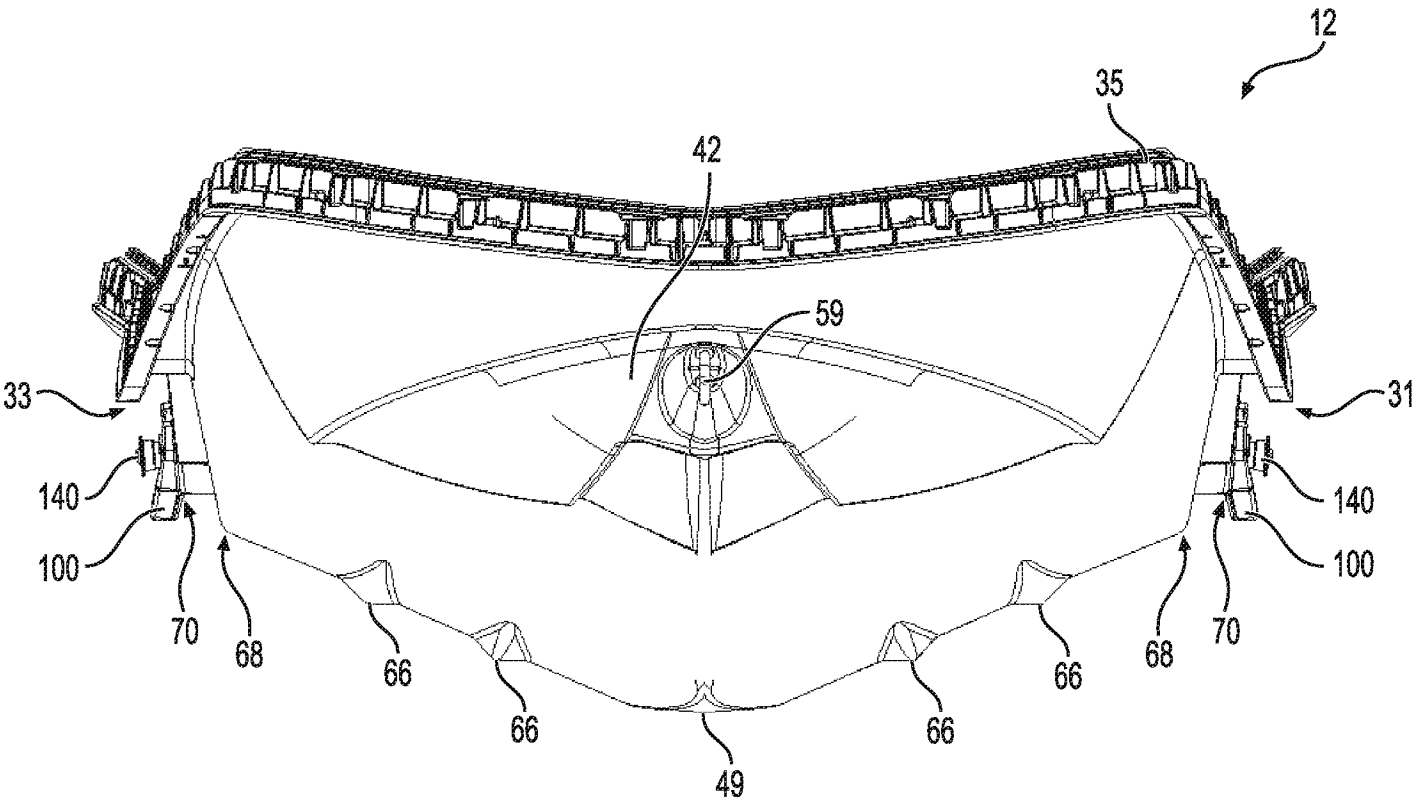
FIG. 4 is a front elevation view of the hull and the adjustable sponson system of FIG. 3.
Figure 5:
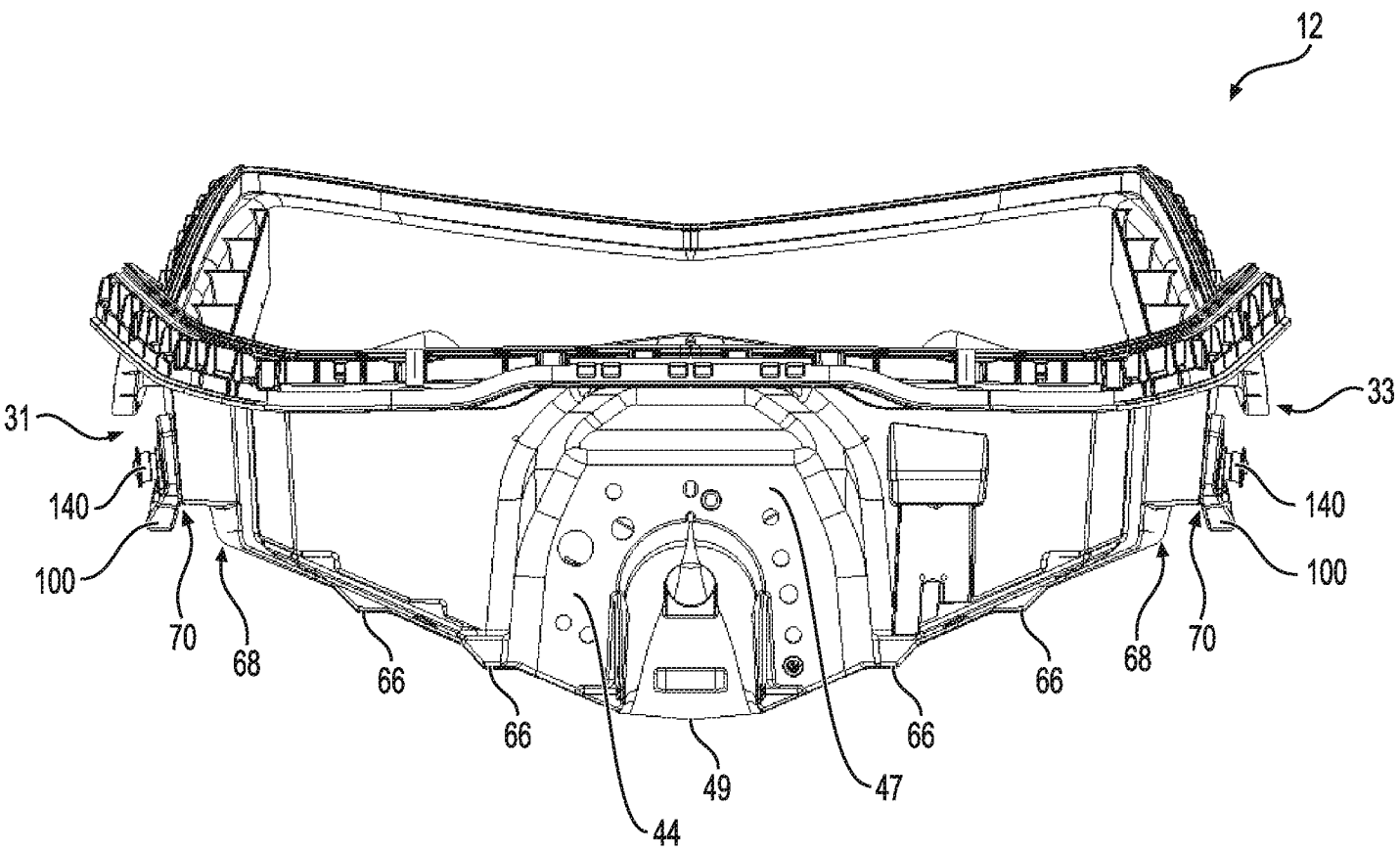
FIG. 5 is a rear elevation view of the hull and the adjustable sponson system of FIG. 3.
Figure 15:
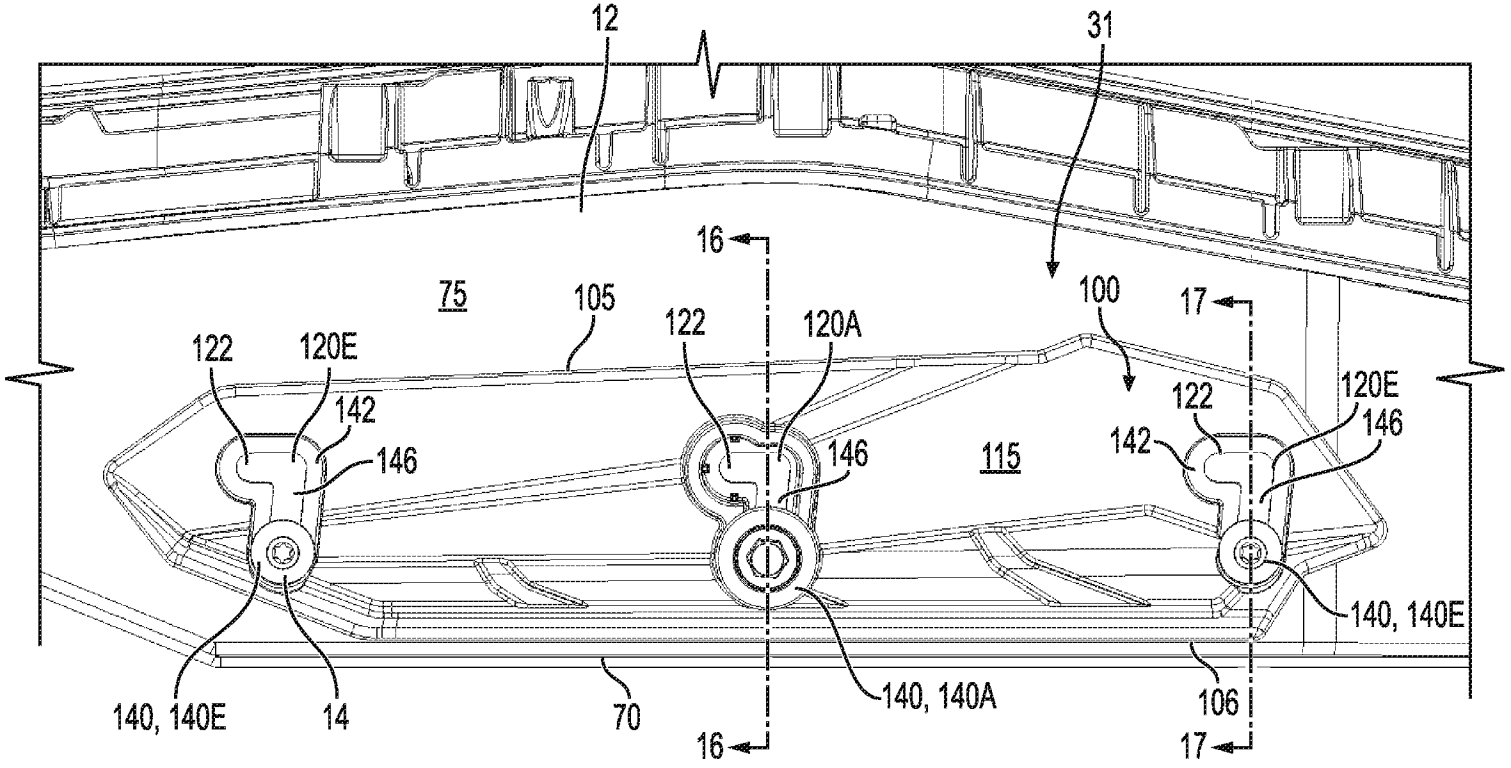
FIG. 15 is a left side elevation view of part of watercraft of FIG. 1, showing the left sponson in a raised position.

The sponsons 100 and the manner in which their position is adjusted to affect the riding behavior of the watercraft 10 will now be described in greater detail. As shown in FIGS. 4 and 5, the sponsons 100 include a left sponson 100 and a right sponson 100 which are disposed on a port side 31 and a starboard side 33 of the hull 12 respectively (i.e., on opposite sides of the longitudinal centerplane 19). More specifically, the left and right sponsons 100 are disposed at a rear portion of the hull 12 on the port side 31 and the starboard side 33. The left and right sponsons 100 are movably connected to the hull 12 such that their respective positions relative to the hull 12 can be adjusted. Notably, each sponson 100 is movable between a raised position (FIGS. 15 to 17) and a lowered position (FIGS. 3 to 8). In the raised position, each sponson 100 is disposed at a first distance, measured along a height direction of the watercraft 10, from the upper end 35 of the hull 12, whereas in the lowered position, each sponson 100 is disposed at a second distance, measured along the height direction of the watercraft 10, from the upper end 35 of the hull 12, with the first distance being smaller than the second distance. In other words, the sponsons 100 are closer to the upper end 35 of the hull 12 (or further from the keel 49) along the height direction of the hull 12 in their raised positions than in their lowered positions. As will be described below, in this embodiment, the sponsons 100 form part of an adjustable sponson system that allows the sponsons 100 to be moved between their raised and lowered positions.

The left sponson 100 will now be described in greater detail with reference to FIGS. 9 to 12. It is to be understood that the right sponson 100 is a mirror image of the left sponson 100 about the longitudinal centerplane 19. Therefore, only the left sponson 100 will be described in detail herein.

Figure 9:
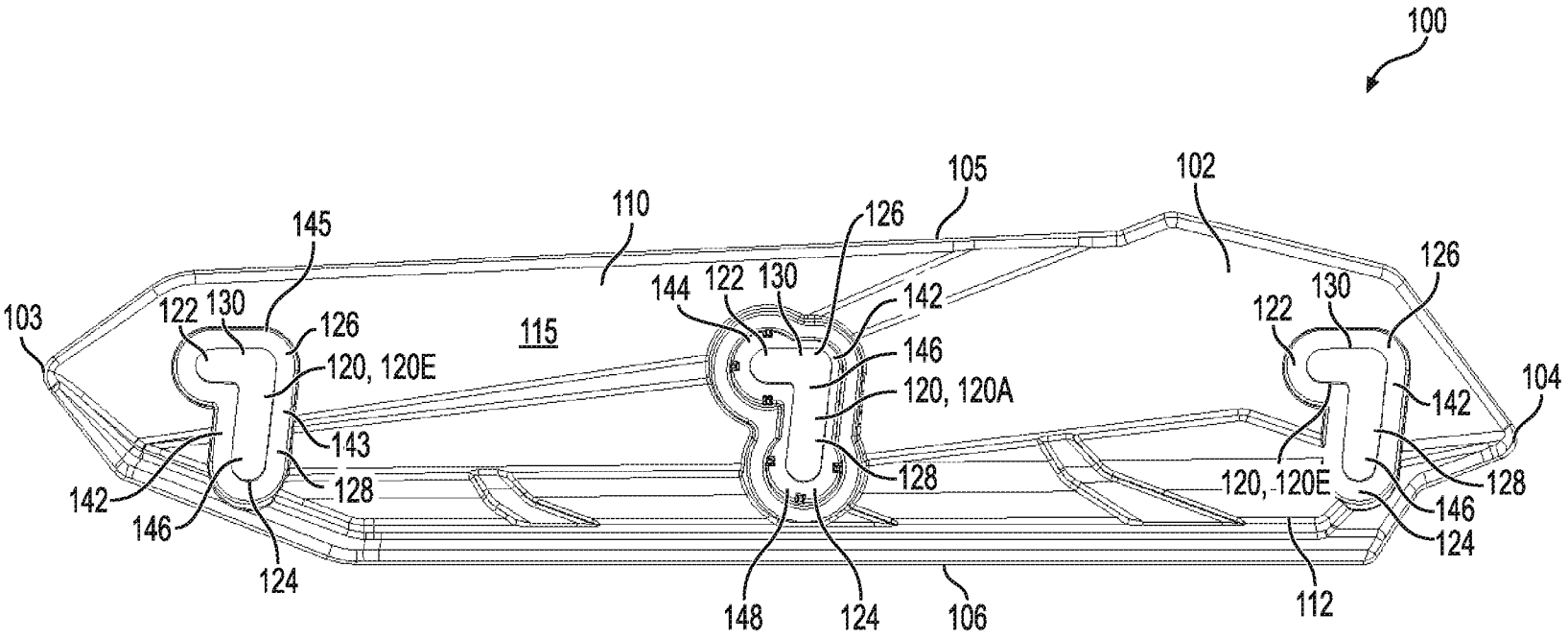
FIG. 9 is a left side elevation view of the left sponson of FIG. 3.
Figure 10:
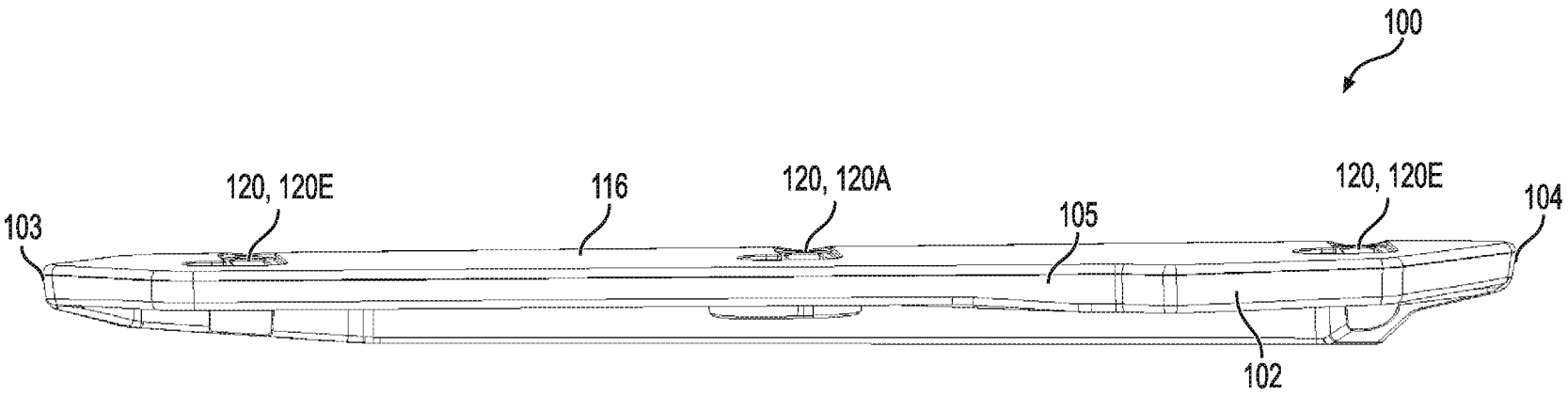
FIG. 10 is a top plan view of the left sponson of FIG. 9.
Figure 11:
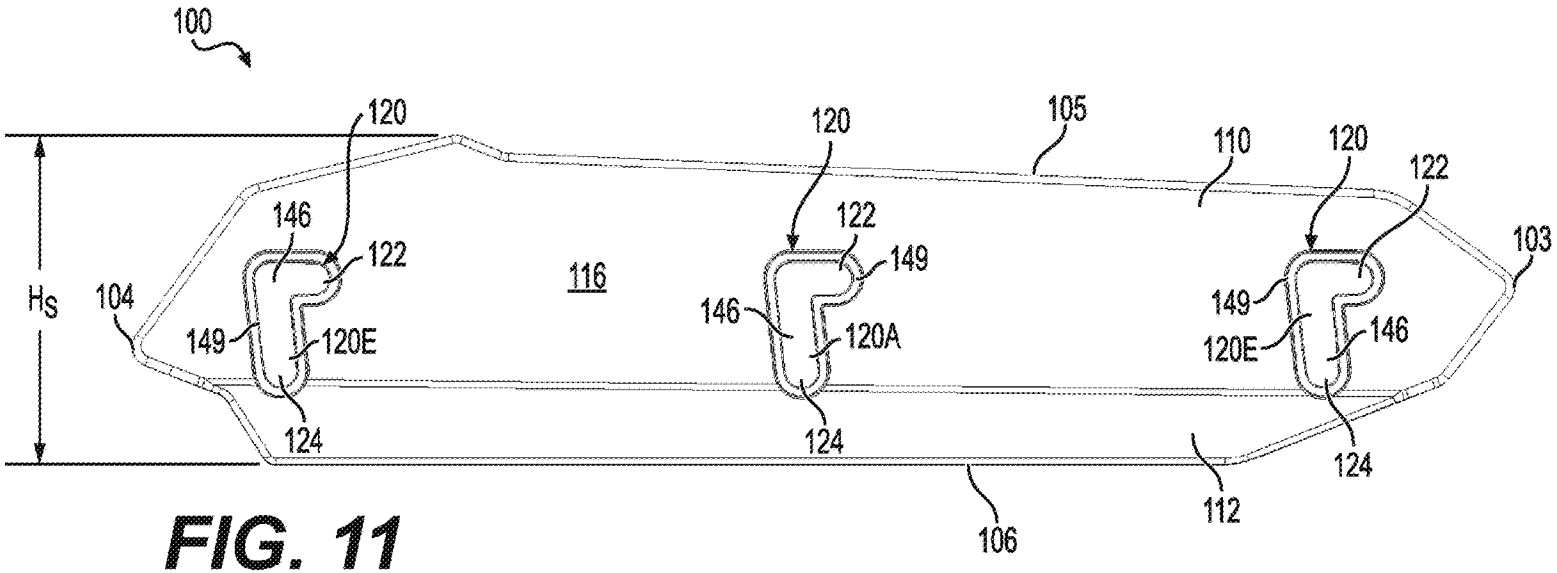
FIG. 11 is a right side elevation view of the left sponson of FIG. 9.
Figure 12:
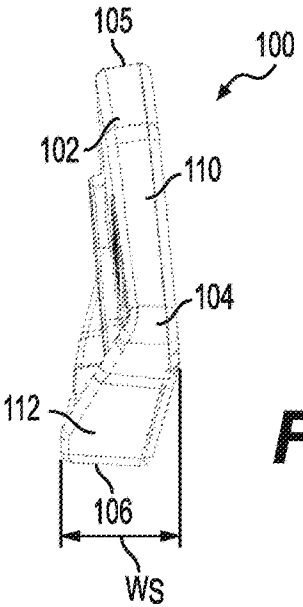
FIG. 12 is a rear elevation view of the left sponson of FIG. 9.

As shown in FIGS. 9 and 10, the sponson 100 has a body 102 that extends from a front end 103 to a rear end 104, defining a length of the sponson 102 therebetween. The body 102 of the sponson 102 also has an upper end 105 and a lower end 106, defining a height of the sponson 100 therebetween. In this embodiment, the sponson 100 extends generally vertically in that the body 102 of the sponson 100 extends primarily vertically and thus has a limited width $W_S$ (FIG. 12). More specifically, as shown in FIG. 11, a height $H_S$ of the sponson 100, measured vertically between the upper end and lower ends 105, 106, is greater than the width $W_S$ of the sponson 100, measured laterally. For instance, in some embodiments, a ratio of the height $H_S$ of the sponson 100 over the width $W_S$ of the sponson 100 is in a range from 2 to 5 inclusively. In particular, in this embodiment, the ratio of the height $H_S$ of the sponson 100 over the width $W_S$ of the sponson 100 is in a range from 3 to 5 inclusively.

Furthermore, in this embodiment, the sponson 100 has an upper portion 110 that is connected to the hull 12 and a lower portion 112 that flares laterally outwardly from the upper portion 110. The intersection between the upper portion 110 and the lower portion 112 is the part of the sponson 100 that is closest to the longitudinal centerplane 19 (i.e., there is no other part of the sponson 100 that is closer to the longitudinal centerplane 19).

The limited width of the sponson 100 is in contrast to conventional sponsons that typically have a horizontally-extending portion having a lower arcuate surface that can provide lift to the watercraft. Notably, the sponson 100 is not designed to provide lift to the watercraft 10. Rather, although it may provide some lift, the laterally compact sponson 100 is mainly designed to affect the turning behavior of the watercraft 10. Nevertheless, it is contemplated that, in other embodiments, the sponson 100 could have a greater width, for example including a laterally-extending portion that is generally normal to the upper portion 110 and or lower portion 112 of the sponson 100. For instance, in such embodiments, the upper and lower portions 110, 112 could form a vertically-extending portion that is movable relative to the laterally-extending portion.

As shown in FIGS. 9 and 11, the sponson 100 defines a plurality of guiding slots 120 for guiding movement of the sponson 100 between its raised and lowered positions. In particular, the guiding slots 120 include three guiding slots 120 that are spaced from each other in a longitudinal direction of the watercraft 10. In this embodiment, the three guiding slots 120 include a front end guiding slot 120E, a rear end guiding slot 120E, and a main guiding slot 120A that is disposed between the front and rear end guiding slots 120E. It is contemplated that more or fewer guiding slots 120 may be provided in other embodiments. For example, in some embodiments, only the main guiding slot 120A may be provided.

In this embodiment, each guiding slot 120, is generally L-shaped and, more specifically, is oriented to look like an upside-down "L". In particular, each guiding slot 120 extends from an upper end 122 to a lower end 124. Starting from the lower end 124, each guiding slot 120 extends vertically upward (i.e., towards the upper end 105 of the sponson 100) to an intermediate corner 126 and then forward to the upper end 122. As such, each guiding slot 120 includes an upright section 128 extending from the lower end 124 to the intermediate corner 126 and a forwardly-extending section 130 extending forward from the intermediate corner 126 to the upper end 122, whereby the upright section 128 and the forwardly-extending section 130 are generally linear and form the L-shape of the guiding slot 120. The forwardly-extending section 130 is shorter than the upright section 128. As will be explained in greater detail below, this shape and orientation of the guiding slots 120 can facilitate handling of external forces applied on the sponson 100 (e.g., by water) so that, when the sponson 100 is in the lowered position, the sponson 100 is not dislodged by the external forces.

As best shown in FIG. 9, in this embodiment, each guiding slot 120 includes an opening 146 extending from an outer surface 115 to an inner surface 116 of the sponson 100 (the opening 146 may thus be referred to as a through opening). The outer surface 115 faces laterally outwardly while the inner surface 116, opposite the outer surface 115, faces laterally inwardly toward the longitudinal centerplane 19. As shown in FIG. 11, each guiding slot 120 also includes an inner recess 149 in communication with the opening 146 of the guiding slot 120 and defined by the inner surface 116 of the sponson 100. Each inner recess 149 surrounds the corresponding opening 146 and thus has a same shape as the opening 146.

Furthermore, each of the front and rear end guiding slots 120E also includes a recess 142 disposed on the outer surface 115 of the sponson 100. Notably, the recess 142 is defined by a bottom surface 143 that faces laterally outwardly and sidewalls 145 (best shown in FIG. 13) that extend laterally outwardly from the bottom surface 143. The recess 142 is in communication with the opening 146 and surrounds the opening 146. In particular, the recess 142 extends from the upper end 122 to the lower end 124 of the guiding slot 120E thereby having a same shape as the opening 146 but with greater dimensions. The end guiding slots 120E may thus be described as counterbored slots.

The main guiding slot 120A has largely the same configuration as the end guiding slots 120E. However, the guiding slot 120A also has an upper recessed portion 144 at the upper end 122 and a lower recessed portion 148 at the lower end 124. The upper and lower recessed portions 144, 148 open into the recess 142. In this embodiment, the upper and lower recessed portions are generally circular. The upper and lower recessed portions 144, 148 are therefore counterbores that are in communication with the recess 142 and the opening 146 of the main guiding slot 120A. As will be described in more detail below, the upper and lower recessed portions 144, 148 help retain the sponson 100 in the lowered and raised positions respectively.

It is contemplated that, in some embodiments, the guiding slots 120 could be defined by the hull 12 instead of the sponson 100.

Figure 6:
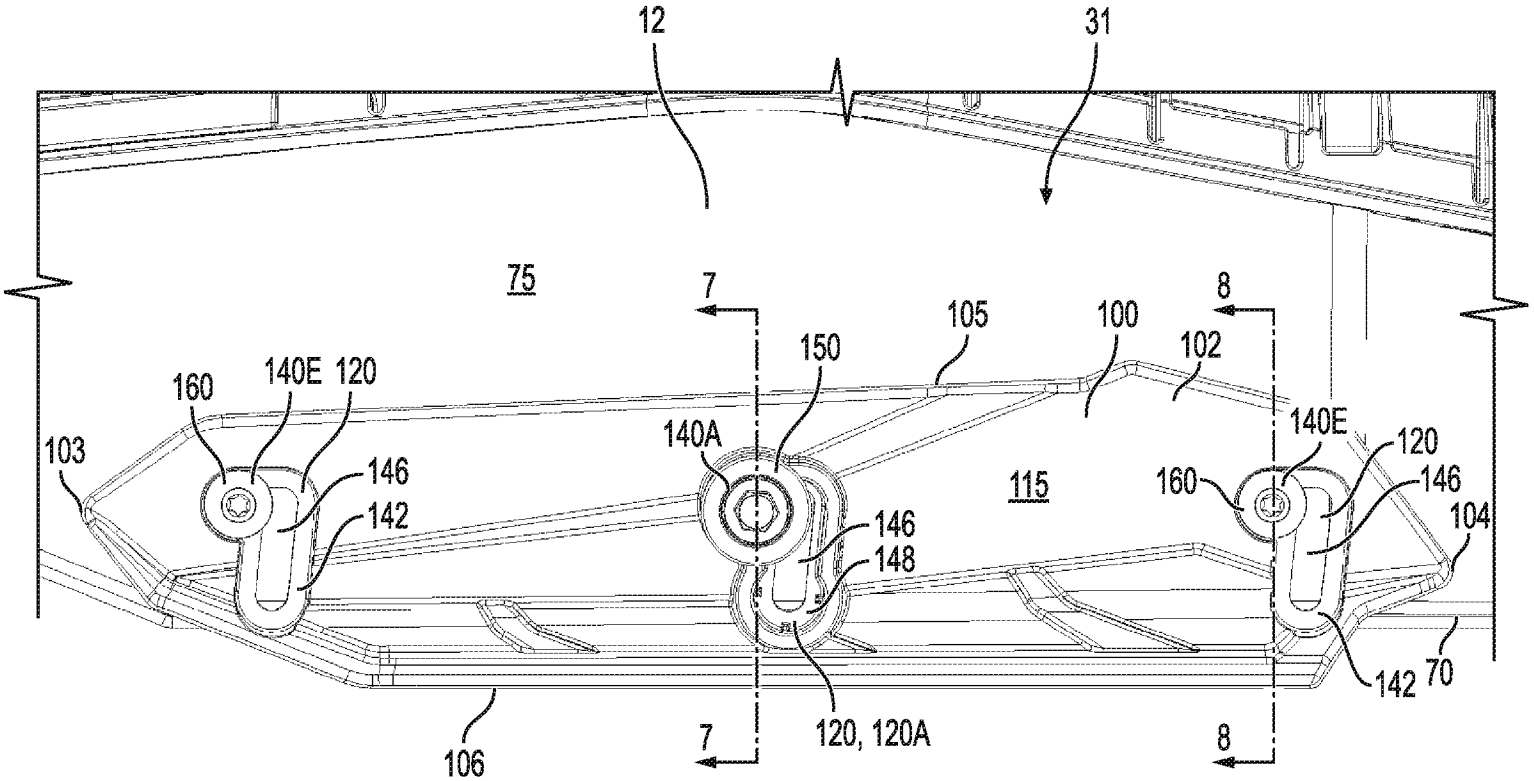
FIG. 6 is a detailed view of part of FIG. 3 showing part of the adjustable sponson system including a left sponson in a lowered position.
Figure 7:
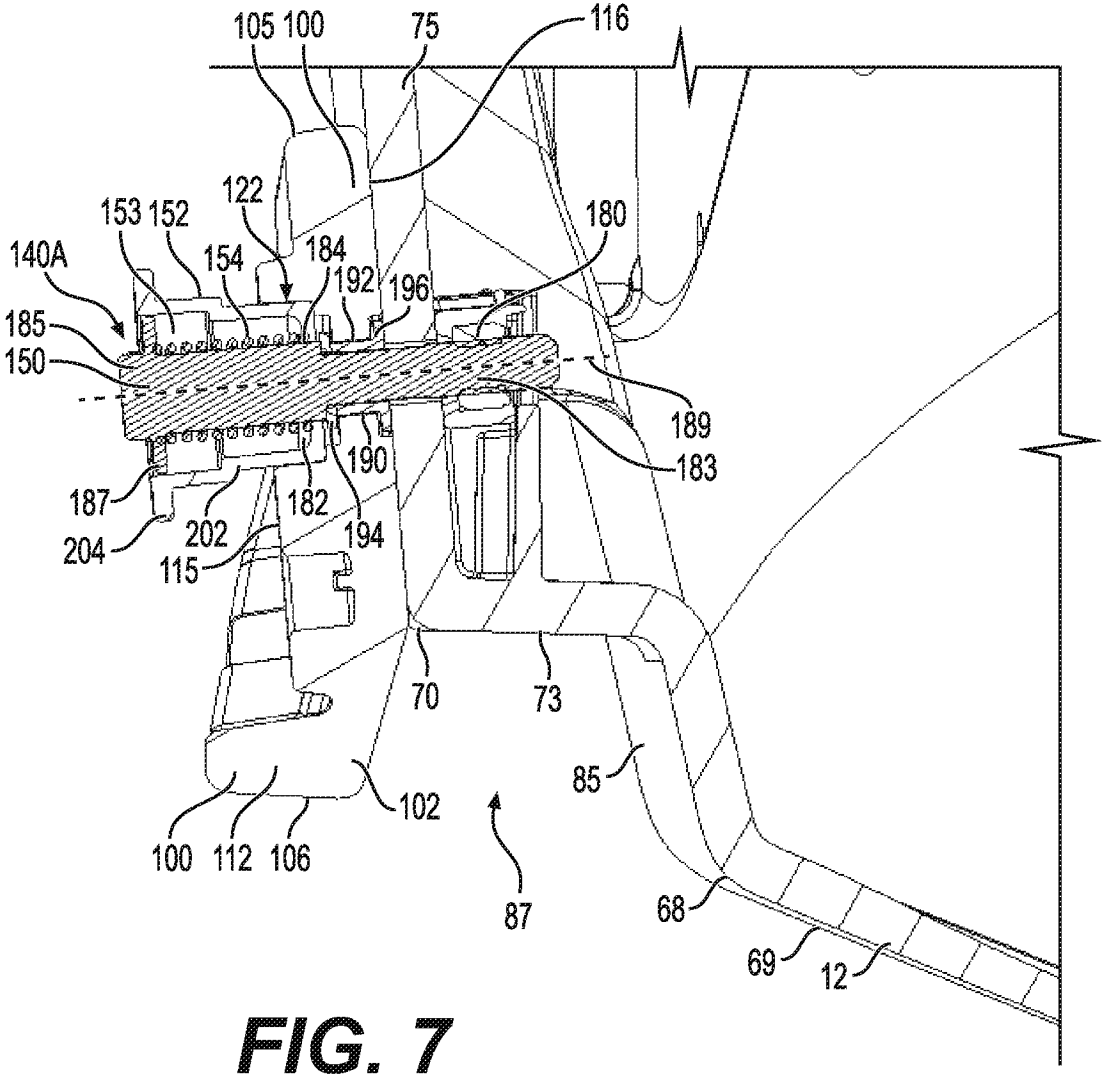
FIG. 7 is a cross-sectional view taken along line 7-7 in FIG. 6.
Figure 8:
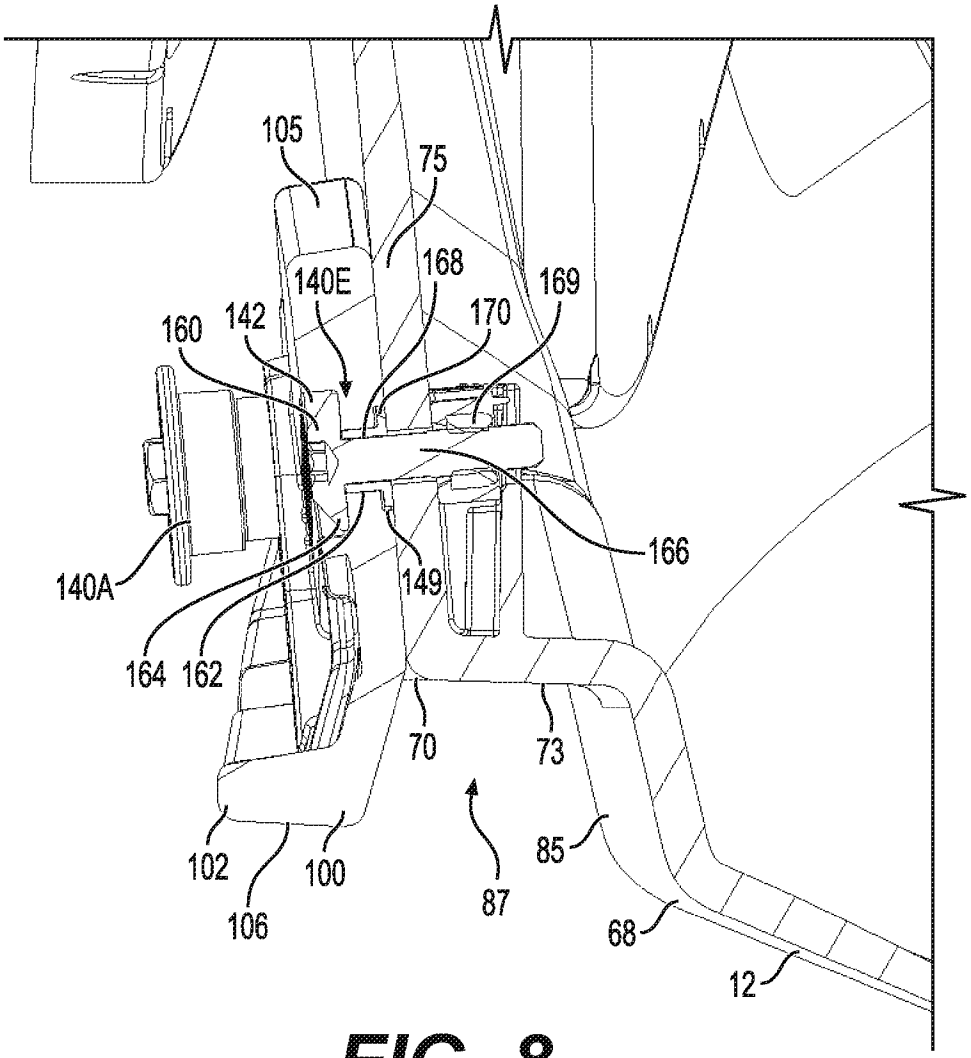
FIG. 8 is a cross-sectional view taken along line 8-8 in FIG. 6.

With reference to FIGS. 6 to 8, the adjustable sponson system also includes, for each of the left and right sponsons 100, a plurality of anchors 140 that connect the sponson 100 to the hull 12. Notably, in this embodiment, on each lateral side of the hull 12, three anchors 140 connect a corresponding sponson 100 to the upwardly-extending surface 75 of the hull 12 that extends upwardly from the corresponding upper chine 70. The three anchors 140 include two end anchors 140E and a middle anchor 140A disposed longitudinally between the two end anchors 140E. Each anchor 140 is received in a corresponding guiding slot 120 and is movable relative to that guiding slot 120 between first and second locations of the guiding slot 120. The sponson 100 is in the raised position when the anchors 140 are at the first locations of the guiding slots 120 (i.e., the sponson 100 is moved to cause relative movement of the anchors 140 along the guiding slots 120 to the first locations). Conversely, the sponson 100 is in the lowered position when the anchors 140 are at the second locations of the guiding slots 120 (i.e., the sponson 100 is moved to cause relative movement of the anchors 140 along the guiding slots 120 to the second locations). In this embodiment, the first locations of the guiding slots 120 correspond to the lower ends 124 while the second locations of the guiding slots 120 correspond to the upper ends 122. In other words, when the anchors 140 securing a given sponson 100 to the hull 12 are at the lower ends 124, the sponson 100 is in the raised position, and when the anchors 140 are at the upper ends 122, the sponson 100 is in the lowered position.

In this embodiment, the front and rear end anchors 140E are configured differently from the middle anchor 140A. Notably, the front and rear end anchors 140E are configured to be moved relative to the corresponding guiding slots 120E without posing resistance to the movement (or posing negligible resistance to the movement). To that end, with reference to FIG. 8, in this embodiment, each of the front end anchor 140E and the rear end anchor 140E includes a fastener 160 and a spacer 162 that is engaged by the fastener 160. The fastener 160 has a head 164 and a shank 166 extending from the head 164. The head 164 and the shank 166 of the fastener 160 are respectively received by the recess 142 and the opening 146 of the corresponding one of the front and rear end guiding slots 120E. As such, the recess 142 of each of the front and rear end guiding slots 120E may also be referred to as a head-receiving recess 142. The size of the opening 146 prevents the head 164 of the corresponding fastener 160 from passing therethrough. Rather, the bottom surface 143 defining the head-receiving recess 142 supports the head 164. The shank 166 of the fastener 160 is threaded in order to secure the fastener 160 to the corresponding upwardly-extending wall 75. In particular, as shown in FIG. 8, the shank 166 extends through the upwardly-extending wall 75 and threadedly engages a receiving fastener 169 (e.g. a nut) disposed on an inner side of the upwardly-extending wall 75.

As shown in FIG. 8, the spacer 162 of each of the front and rear end anchors 140E is partially disposed within the opening 146 of the corresponding end guiding slot 120E and receives the shank 166 of the fastener 160. In particular, a cylindrical portion 168 of the spacer 162 extends within the opening 146 while an annular lip 170 of the spacer 162 extending radially outwardly from the cylindrical portion 168 is received in the inner recess 149 of the guiding slot 120. As such, the spacer 162 is disposed between the sponson 100 and the upwardly-extending wall 75 of the hull 12. The spacer 162 may facilitate the displacement of the anchors 140E relative to the guiding slots 120E, notably by preventing the fastener 160 from overtightening the sponson 100 to the corresponding upwardly-extending wall 75.

The middle anchor 140A is an actuatable anchor 140A that selectively secures the corresponding sponson 100 in the raised position and in the lowered position. As will be described below, the actuatable anchor 140A is configured such that, when received at the upper and lower ends 122, 124 of the main guiding slot 120A, the actuatable anchor 140A is actuated in order to move it away from the upper or lower end 122, 124.

Figure 13:
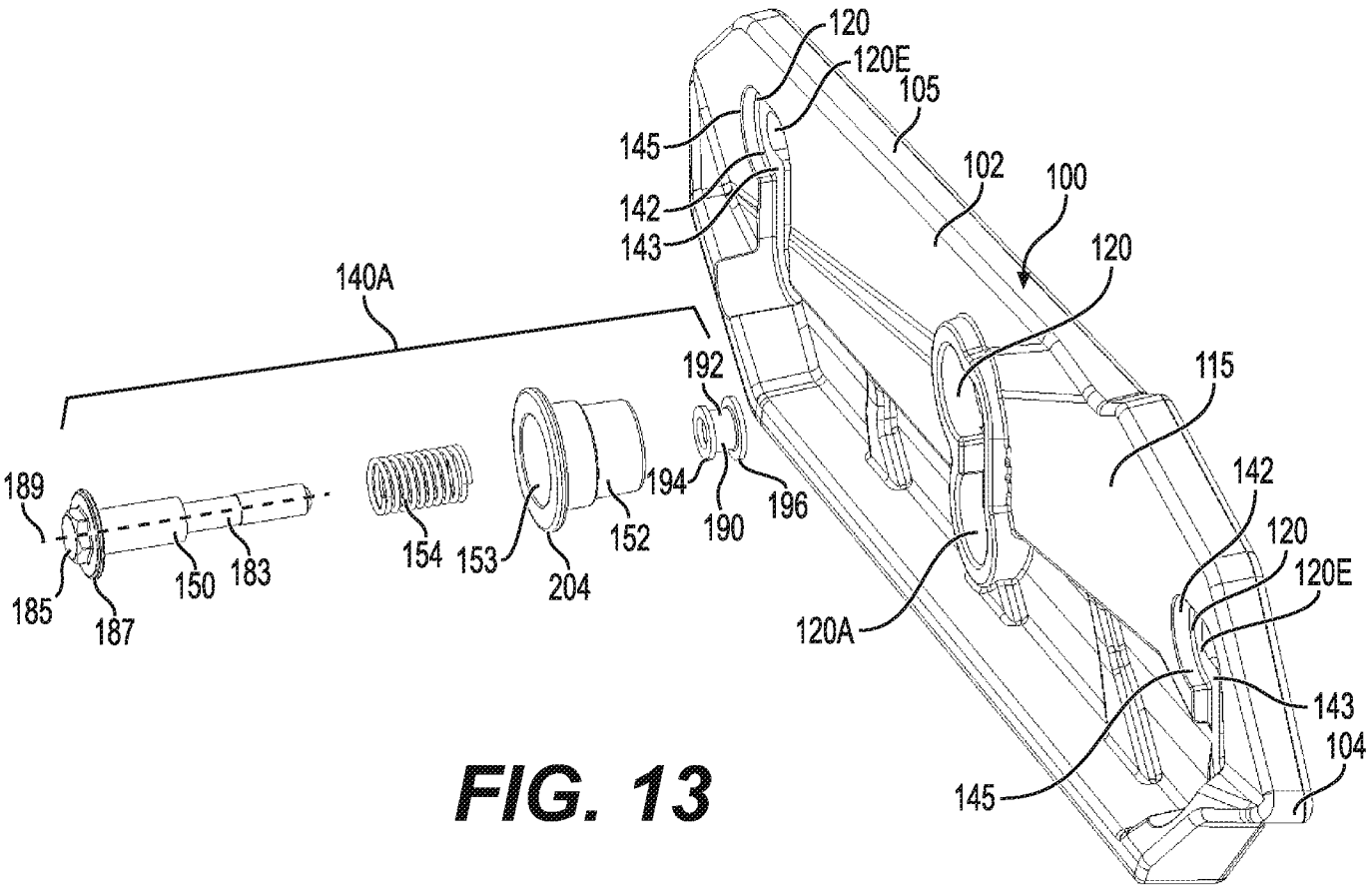
FIG. 13 is a perspective view taken from a top, rear, left side of the left sponson of FIG. 9 and an actuatable anchor of the adjustable sponson system, shown in an exploded configuration.

With reference to FIGS. 7 and 13, in this embodiment, the actuatable anchor 140A includes a fastener 150 for fixing the actuatable anchor 140A to the hull 12 and a handle 152 for actuating the actuatable anchor 140A. As shown in FIG. 7, the fastener 150 extends through the opening 146 of the guiding slot 120A and through the upwardly-extending wall 75 on the port side 31 or starboard side 33 of the hull 12. A shank 183 of the fastener 150 threadedly engages a receiving fastener 180 disposed on the inner side of the upwardly-extending wall 75 such as to secure the fastener 150 to the hull 12. The handle 152 defines a handle recess 153 that partly receives the fastener 150 therein. Notably, the fastener 150 extends through a bottom wall 184 of the handle 152 via a handle opening 184 defined by the bottom wall 182. The handle 152 also has a cylindrical wall 202 extending from the bottom wall 184. Together, the cylindrical wall 202 and the bottom wall 184 define the handle recess 153. The handle 152 also has an outer flange 204 that extends radially outwardly from an end of the cylindrical wall 202 opposite the bottom wall 184. The outer flange 204 can facilitate handling of the handle 152 by the user.

Figure 14:
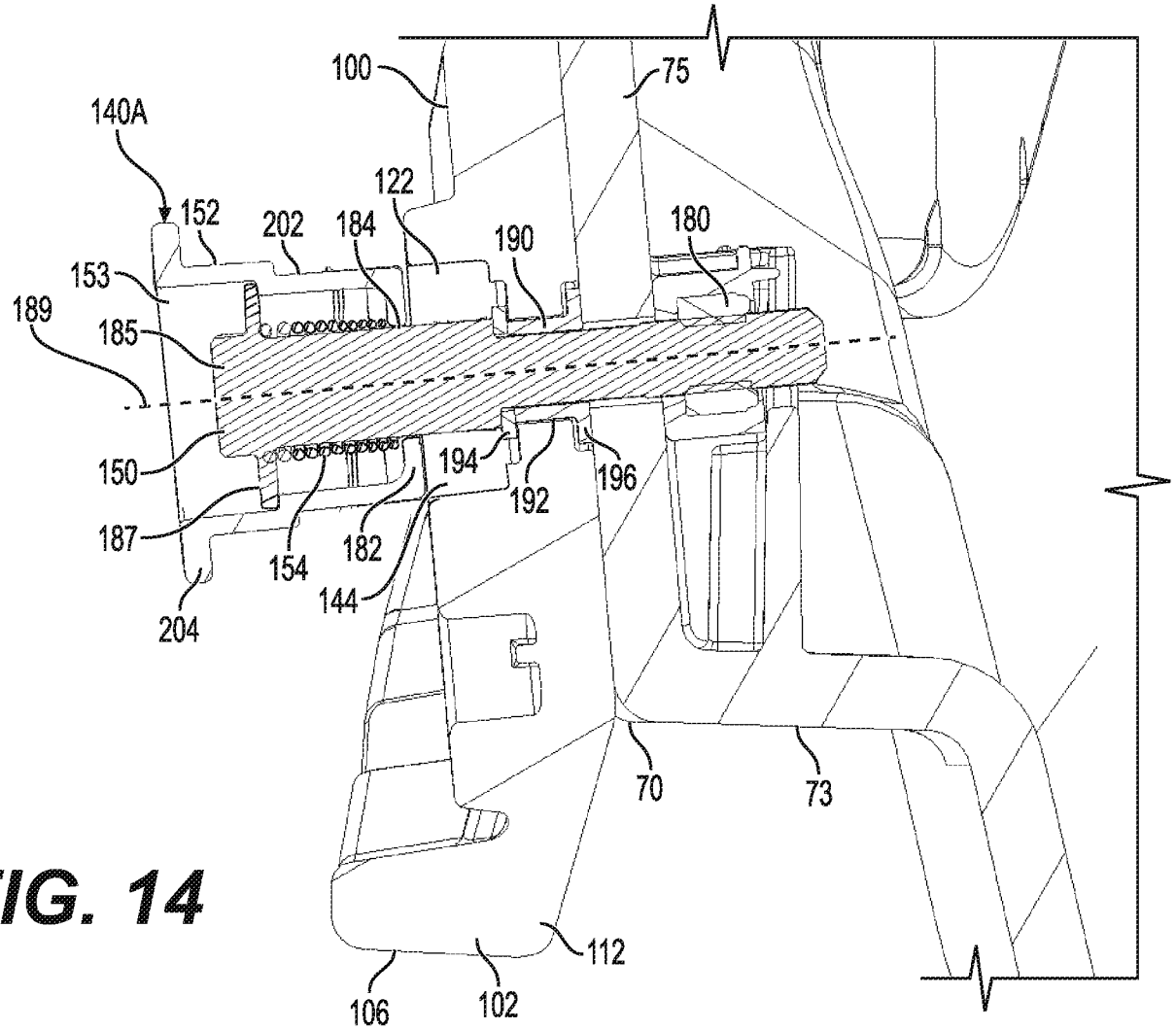
FIG. 14 is a cross-sectional view of the left sponson taken along the actuatable anchor, showing a handle of the actuatable anchor in an unlocked position.

The handle 152 is movable between a locked position (FIG. 7) and an unlocked position (FIG. 14). Notably, in the unlocked position, the bottom wall 182 of the handle 152 is disposed closer to a head 185 of the fastener 150 whereas in the locked position, the bottom wall 182 of the handle 152 is disposed further from the head 185 of the fastener 150. In other words, the handle 152 is movable along an axis 189 defined by the fastener 150 in order to move between the locked and unlocked positions. As will be explained in more detail below, this allows the anchor 140A to be selectively retained at the upper end 122 or the lower end 124 of the main guiding slot 120A. Notably, the upper and lowered recessed portion 144, 148 of the main guiding slot 120A are configured to receive the handle 152.

In this embodiment, the actuatable anchor 140A also includes a spring 154 which surrounds part of the shank 183 of the fastener 150. In particular, the spring 154 is disposed between the bottom wall 182 of the handle 152 and the head 185 of the fastener 150. That is, one end of the spring 154 is supported by an annular flange 187 of the head 185 while the opposite end of the spring 154 is supported by the bottom wall 182 of the handle 152. The spring 154 thus biases the handle 152 toward the locked position by forcing the bottom wall 182 of the handle 152 away from the head 185 of the fastener 150.

Moreover, in this embodiment, the actuatable anchor 140A also includes a spacer 190 disposed between the sponson 100 and the hull 12. In particular, in this example, the spacer 190 is generally shaped like a bobbin, notably having a cylindrical portion 192 and outer and inner annular flanges 194, 196 extending radially outwardly from the cylindrical portion 192 at opposite ends thereof. The spacer 190 defines an opening through which the fastener 150 extends. The inner annular flange 196 is received in the inner recess 149 (FIG. 11) of the main guiding slot 120A, on an inner side of the sponson 100. The spacer 190 may facilitate the displacement of the actuatable anchor 140A relative to the main guiding slot 120A, notably by preventing the fastener 150 from overtightening the sponson 100 to the corresponding upwardly-extending wall 75.

The manner in which the sponson 100 is moved between the raised and lowered positions and the effect these positions of the sponson 100 have on the handling characteristics of the watercraft 10 will now be described in greater detail.

With reference to FIG. 7, starting from the lowered position of the sponson 100, the anchors 140 are positioned at the upper ends 122 of the corresponding guiding slots 120. In the lowered position of the sponson 100, the sponson 100 is disposed adjacent to the corresponding upper chine 70 and the lower end 106 of the sponson 100 is disposed lower than the corresponding upper chine 70. That is, the lower end 106 of the sponson 100 is disposed, along the height direction of the watercraft 10, lower than the upper chine 70 on the same side of the longitudinal centerplane 19. Moreover, in the lowered position of the sponson 100, a portion of the inner surface 116 that is aligned, in the height direction, with the corresponding upwardly-extending wall 75 of the hull 12 is mated therewith and therefore that portion of the inner surface 116 is in contact with the upwardly-extending wall 75. It is contemplated that, in some embodiments, in the lowered position of the sponson 100, part of the inner surface 116 that is aligned, in the height direction, with the corresponding upwardly-extending wall 75 of the hull 12 could be spaced from the upwardly-extending wall 75 by a small distance such as to define a small gap between the inner surface 116 and the upwardly-extending wall 75.

The shape and orientation of the guiding slots 120 also facilitate retaining the sponson 100 in the lowered position. Notably, with reference to FIG. 6, when the sponson 100 is in the lowered position, the anchors 140 are in the forwardly-extending sections 130 of the guiding slots 120 and therefore the three anchors 140 support the sponson 100 vertically (i.e., along the height direction of the watercraft 10). This would not be the case for example if the guiding slots 120 were simply linear from the upper end 122 to the lower end 124, as only the actuatable anchor 140A could then support the sponson 100 vertically via the handle 152. Furthermore, because the anchors 140 are in the forwardly-extending sections 130 of the guiding slots 120 when the sponson 100 is in the lowered position and the watercraft 10 is moving forward, the water acting on the sponson 100 applies a rearward force on the sponson 100 which forces the anchors 140 against the walls defining the upper ends 122 of the guiding slots 120. This further ensures that the sponson 100 is not moved by the force of the water acting on the sponson 100.

When the sponsons 100 are in the lowered position and the watercraft 10 turns, the sponson 100 on the side toward which the watercraft 10 is turning cuts into the water to decrease a turning radius of the watercraft 10. In other words, the lowered position of the sponson 100 allows sharper turns by the watercraft 10 which may be preferred by riders that desire a quicker and responsive handling of the watercraft 10 when turning.

As mentioned above, in this embodiment, the sponson 100 does not have a substantial width and therefore does not provide substantial lift to the watercraft 10, even in the lowered position. Rather, in this embodiment, an inwardly-extending surface 73 that extends laterally inwardly from the corresponding upper chine 70 (i.e., a left inwardly-extending surface 73 extending laterally inwardly from the left upper chine 70 or a right inwardly-extending surface 73 extending laterally inwardly from the right upper chine 70) provides lift to the watercraft 10 when the watercraft 10 is turning in the direction of the sponson. As shown in FIG. 7, in this example, the inwardly-extending surface 73 is generally horizontal and thus generally perpendicular to the longitudinal centerplane 19. It is contemplated that, in other embodiments, the inwardly-extending surface 73 could be diagonal rather than horizontal. In the lowered position of the sponson 100, part of the inner surface 116 of the sponson 100, the inwardly-extending surface 73 and a downwardly-extending surface 85 of the hull 12 that extends downwardly from the inwardly-extending surface 73 form a channel 87.

However, as mentioned above, it is contemplated that, in some embodiments, the sponson 100 could also have a laterally-extending portion that is designed to provide lift to the watercraft 10 in the lowered position of the sponson 100.

In order to move the sponson 100 from the lowered position, the handle 152 of the actuatable anchor 140A is moved from the locked position to the unlocked position (FIG. 14). Notably, the upper and lower recessed portions 144, 148 of the main guiding slot 120A are shaped and sized to prevent the actuatable anchor 140A from moving relative to the main guiding slot 120A from the upper and lower ends 122, 124 respectively when the handle 152 is received therein and is in the locked position. More specifically, each of the upper and lower recessed portions 144, 148 has a diameter that is approximately equal to a diameter of the handle 152. However, the connection of the upper and lower recessed portions 144, 148 with the recess 142 is sized smaller than the diameter of the handle 152 such that, when the handle 152 is received in the upper recessed portion 144 or the lower recessed portion 148 (i.e., in its locked position), the sponson 100 cannot be displaced such that the fastener 150 moves relative to the guiding slot 120A since the handle 152 cannot fit through the connection between either of the upper and lower recessed portions 144, 148 and the recess 142 and/or the opening 146. The actuatable anchor 140A is thus movable relative to the main guiding slot 120A from the upper and lower ends 122, 124 when the handle 152 is in the unlocked position.

Thus, with reference to FIG. 14, when the sponson 100 is in the lowered position, in order to move the handle 152 to the unlocked position, the handle 152 is moved along the axis 189 of the fastener 150 until the handle 152 is disposed outside of the upper recessed portion 144 at the upper end 122 of the main guiding slot 120A. As will be appreciated, the handle 152 can be moved by the user's hand to the unlocked position. Therefore, the handle 152 can be moved toollessly by the user. Once the handle 152 is disposed outside of the upper recessed portion 144, the actuatable anchor 140A is thus permitted to move relative to the main guiding slot 120A. As such, the sponson 100 can now be moved to the raised position.

The sponson 100 is thus moved forward and then upward by the user such that the anchors 140 describe a generally L-shaped path as the anchors 140 are moved simultaneously relative to the guiding slots 120 from the upper ends 122 to the lower ends 124 thereof. In particular, the sponson 100 is translated from the lowered position to the raised position. It is contemplated that, in some embodiments, the sponson 100 could undergo some rotation in addition to the translation as it is moved between the lowered and raised positions. Once the anchors 140 are at the lower ends 124 and the user has let go of the handle 152 of the actuatable anchor 140A, the handle 152 is biased to the locked position by the spring 154 such that the handle 152 is received in the lower recessed portion 148 defined at the lower end 124 of the main guiding slot 120A.

Figure 16:
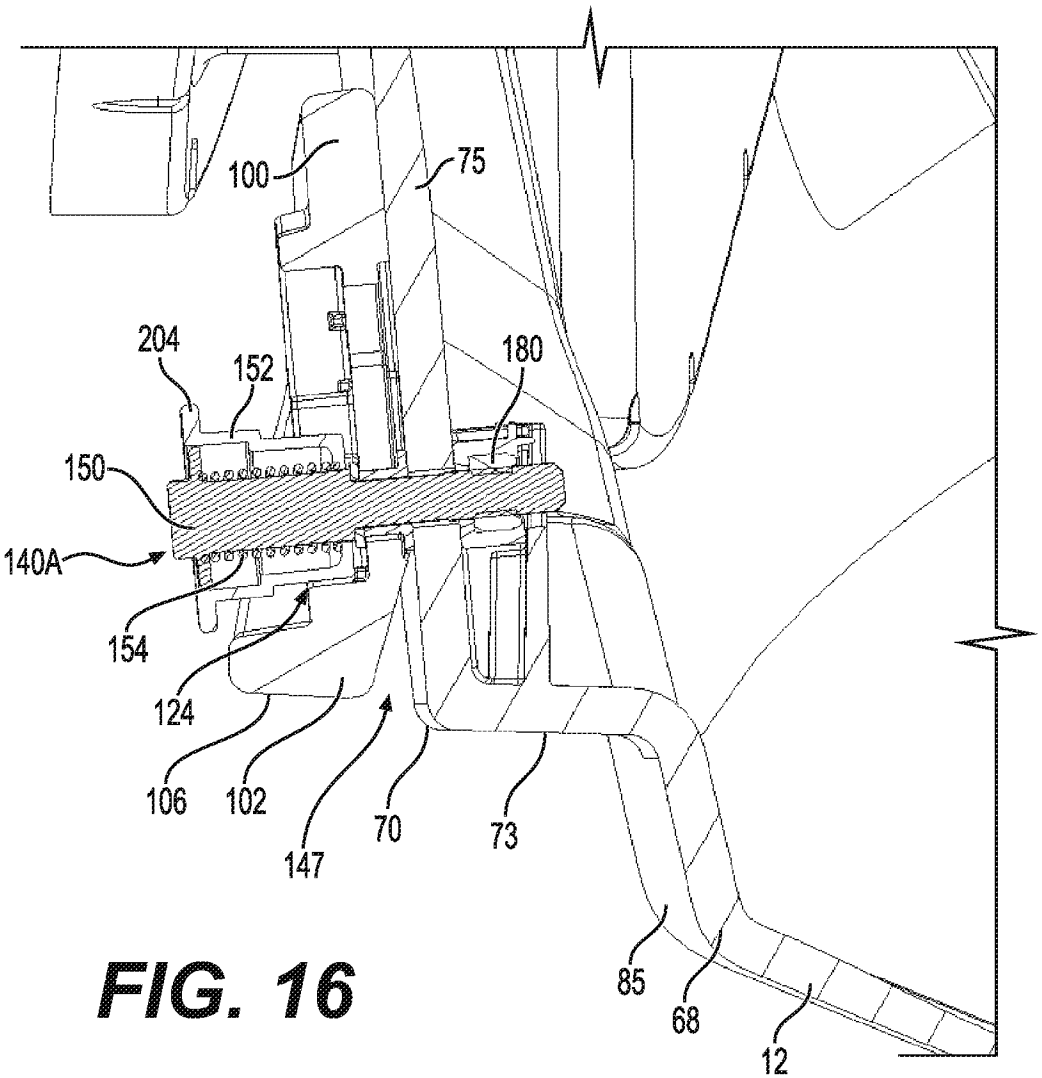
FIG. 16 is a cross-sectional view taken along line 16-16 in FIG. 15.
Figure 17:
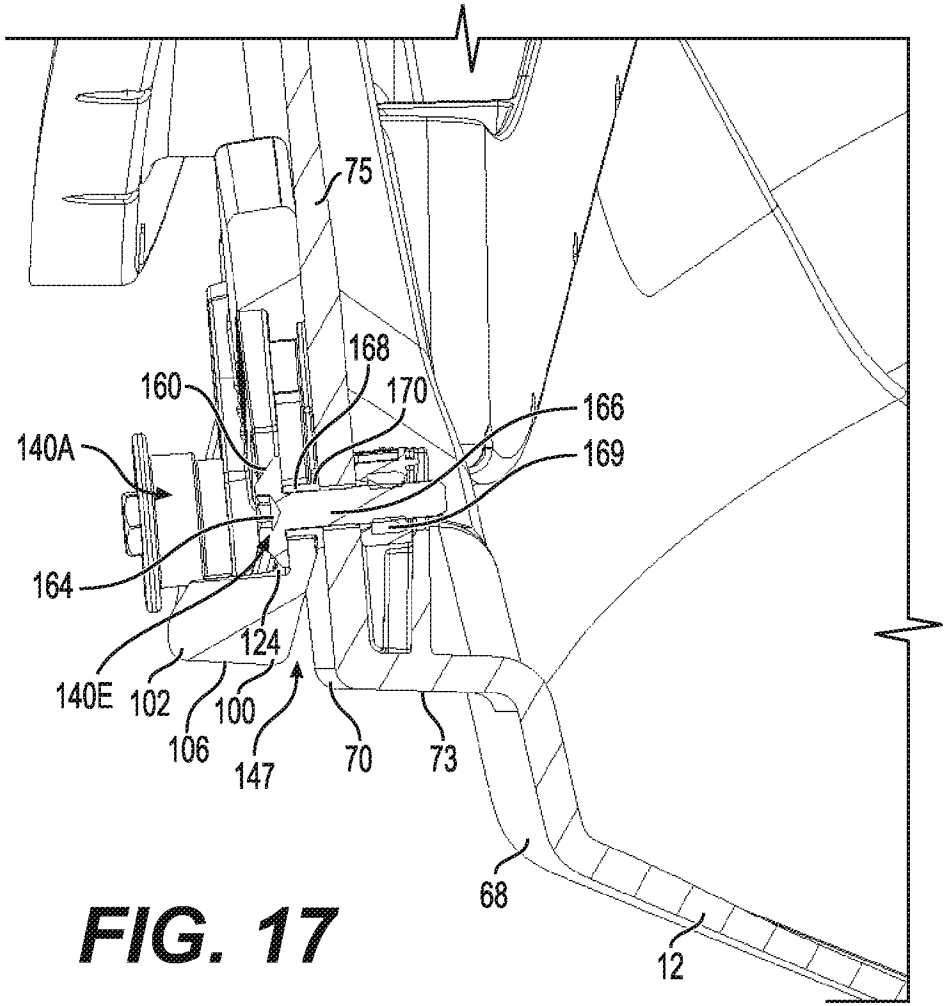
FIG. 17 is a cross-sectional view taken along line 17-17 in FIG. 15.

Once the anchors 140 are at the lower ends 124 of the guiding slots 120, the sponson 100 is in the raised position. In the raised position of the sponson 100, the lower end 106 of the sponson 100 is disposed higher than the corresponding upper chine 70 as shown in FIG. 16. That is, the lower end 106 of the sponson 100 is disposed, along the height direction of the watercraft 10, higher than the upper chine 70 on the same side of the longitudinal centerplane 19. Moreover, in the raised position of the sponson 100, the inner surface 116 of the sponson 100 is spaced from the corresponding upwardly-extending wall 75 of the hull 12 to define a gap 147 between the upwardly-extending wall 75 and the inner surface 116. The distance by which the inner surface 116 of the sponson 100 is spaced from the upwardly-extending wall 75 in the raised position of the sponson 100 is greater than a distance by which the inner surface 116 could be spaced from the upwardly-extending wall 75 in the lowered position of the sponson 100. Notably, in this embodiment, the lower portion 112 of the sponson 100 defines the gap 147 between the sponson 100 and the upwardly-extending wall 75.

When the sponsons 100 are in the raised position and the watercraft 10 turns, the sponson 100 on the side toward which the watercraft 10 is turning does not engage the water sufficiently to affect the turning radius of the watercraft 10. For example, that sponson 100 may not engage the water at all during the turn. As such, in the raised position of the sponsons 100, the watercraft 10 is allowed to "drift" when performing a turn. More specifically, during a turn with the sponsons 100 in the raised position, the stern 44 swings out, sliding laterally along a greater distance than when the sponsons 100 are in the lowered position. This provides a more relaxed handling of the watercraft 10 which may be preferred by some riders.

The sponsons 100 can be moved back to the lowered position in a similar manner and thus will not be described herein.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a deck;

a hull supporting the deck;

left and right sponsons movably connected to the hull and disposed on opposite sides of a longitudinal centerplane of the watercraft, each sponson of the left and right sponsons being movable between a raised position and a lowered position;

for each sponson of the left and right sponsons:

an actuatable anchor connecting the sponson to the hull, the actuatable anchor selectively securing the sponson in the raised position and in the lowered position, the actuatable anchor comprising a handle that is movable between a locked position and an unlocked position, the handle being biased toward the locked position; and a guiding slot defined by one of the hull and the sponson for guiding movement of the sponson between the raised position and the lowered position, the actuatable anchor being received in the guiding slot, the actuatable anchor being movable relative to the guiding slot between a first location and a second location of the guiding slot, the sponson being in the raised position when the actuatable anchor is moved relative to the guiding slot to the first location, the sponson being in the lowered position when the actuatable anchor is moved relative to the guiding slot to the second location, the guiding slot having a first recessed portion at the first location and a second recessed portion at the second location, the first and second recessed portions being configured to receive the handle of the actuatable anchor, the first and second recessed portions being shaped and sized to prevent the actuatable anchor from moving relative to the guiding slot from the first and second locations when the handle is received therein and is in the locked position, the actuatable anchor being movable relative to the guiding slot from the first location and the second location when the handle is in the unlocked position.

2. The watercraft of claim 1, wherein for each sponson of the left and right sponsons:

the guiding slot is defined by the sponson; and the actuatable anchor is connected to the hull.

3. The watercraft of claim 1, wherein, for each sponson of the left and right sponsons, the sponson is translatable between the raised position and the lowered position.

4. The watercraft of claim 1, wherein the guiding slot is a main guiding slot, the watercraft further comprising for each sponson of the left and right sponsons:

at least one additional anchor connecting the sponson to the hull; and at least one additional guiding slot defined by the one of the hull and the sponson, the at least one additional anchor being received in the at least one additional guiding slot, the at least one additional anchor being movable relative to the at least one additional guiding slot between first and second locations of the at least one additional guiding slot, the sponson being in the raised position when the actuatable anchor is in the first location of the main guiding slot and the at least one additional anchor is in the first location of the at least one additional guiding slot, the sponson being in the lowered position when the actuatable anchor is in the second location of the main guiding slot and the at least one additional anchor is in the second location of the at least one additional guiding slot.

5. The watercraft of claim 4, wherein the at least one additional anchor includes two additional anchors, the actuatable anchor being disposed between the two additional anchors in a longitudinal direction of the watercraft.

6. The watercraft of claim 4, wherein:

the at least one additional anchor comprises a fastener comprising a shank and a head; and the at least one additional guiding slot defines a head-receiving recess and an opening in communication with the head-receiving recess, the head-receiving recess and the opening respectively receiving the head and the shank of the fastener of the at least one additional anchor.

7. The watercraft of claim 6, wherein the head-receiving recess extends from the first location to the second location of the at least one additional guiding slot.

8. The watercraft of claim 6, wherein the at least one additional anchor further comprises a spacer disposed between the sponson and the hull.

9. The watercraft of claim 1, wherein the actuatable anchor further comprises:

a fastener defining an axis; and a spring surrounding part of the fastener for biasing the handle toward the locked position, the handle defining a handle recess at least partially receiving the fastener, the handle being movable along the axis of the fastener between the locked position and the unlocked position.

10. The watercraft of claim 1, wherein the guiding slot is generally L-shaped such that the actuatable anchor describes a generally L-shaped path in moving relative to the guiding slot between the first and second locations thereof.

11. The watercraft of claim 10, wherein the guiding slot extends vertically upward from the first location and then forward to the second location.

12. The watercraft of claim 1, wherein:

the hull comprises left and right chines;

for each sponson of the left and right sponsons:

the sponson extends generally vertically, the sponson having a width measured laterally and a height measured vertically;

the height of the sponson is greater than the width of the sponson;

in the lowered position, the sponson is disposed adjacent to a corresponding chine of the left and right chines.

13. The watercraft of claim 12, wherein, for each sponson of the left and right sponsons, a ratio of the height of the sponson over the width of the sponson is between 2 and 5 inclusively.

14. The watercraft of claim 13, wherein the ratio of the height of the sponson over the width of the sponson is between 3 and 5 inclusively.

15. The watercraft of claim 1, wherein for each sponson of the left and right sponsons:

the sponson comprises an upper portion that is connected to the hull and a lower portion that flares laterally outwardly from the upper portion; and the upper portion is a part of the sponson that is closest to the longitudinal centerplane of the watercraft.

16. The watercraft of claim 1, wherein:

the hull comprises a left upwardly-extending wall that extends upwardly from a left chine and a right upwardly-extending wall that extends upwardly from a right chine;

for each sponson of the left and right sponsons:

the sponson comprises an outer surface and an inner surface, the inner surface facing laterally inwardly toward the longitudinal centerplane of the watercraft, the sponson being connected to a corresponding one of the left and right upwardly-extending walls of the hull;

in the raised position of the sponson:

a lower end of the sponson is disposed higher than a corresponding one of the left and right chines on a same side of the longitudinal centerplane of the watercraft; and the inner surface of the sponson is spaced from the corresponding one of the left and right upwardly-extending walls by a first distance to define a gap between the corresponding one of the upwardly-extending walls and the inner surface; and in the lowered position of the sponson:

the lower end of the sponson is disposed lower than the corresponding one of the left and right chines on the same side of the longitudinal centerplane of the watercraft; and a portion of the inner surface of the sponson that is aligned with the corresponding one of the left and right upwardly-extending walls in a height direction of the watercraft is:

mated with the corresponding one of the left and right upwardly-extending walls such that the inner surface is in contact with the corresponding one of the left and right upwardly-extending walls; or spaced from the corresponding one of the left and right upwardly-extending walls by a second distance smaller than the first distance to define a reduced gap between the corresponding one of the left and right upwardly-extending walls and the inner surface.

17. The watercraft of claim 16, wherein the hull further comprises:

a left inwardly-extending surface that extends laterally inwardly from the left chine; and a right inwardly-extending surface that extends laterally inwardly from the right chine, the left and right inwardly-extending surfaces being generally perpendicular to the longitudinal centerplane of the watercraft.

18. The watercraft of claim 16, wherein:

the left and right chines are first left and right chines; and the hull further comprises a second left chine and a second right chine disposed lower than the first left and right chines respectively along the height direction of the watercraft.

19. An adjustable sponson system for a watercraft, comprising:

left and right sponsons configured to be movably connected to a hull of the watercraft, each sponson of the left and right sponsons being configured to be moved relative to the hull between a raised position and a lowered position, each sponson of the left and right sponsons defining a guiding slot for guiding movement of the sponson between the raised position and the lowered position; and for each sponson of the left and right sponsons:

an actuatable anchor configured to connect the sponson to the hull, the actuatable anchor selectively securing the sponson in the raised position and in the lowered position, the actuatable anchor comprising a handle that is movable between a locked position and an unlocked position, the handle being biased toward the locked position, the actuatable anchor being received in the guiding slot, the actuatable anchor being movable relative to the guiding slot between a first location and a second location of the guiding slot, the sponson being configured to be in the raised position when the actuatable anchor is moved relative to the guiding slot to the first location of the guiding slot, the sponson being configured to be in the lowered position when the anchor is moved relative to the guiding slot to the second location of the guiding slot, the guiding slot having a first recessed portion at the first location and a second recessed portion at the second location, the first and second recessed portions being configured to receive the handle of the actuatable anchor, the first and second recessed portions being shaped and sized to prevent the actuatable anchor from moving relative to the guiding slot from the first and second locations when the handle is received therein and is in the locked position, the actuatable anchor being movable relative to the guiding slot from the first location and the second location when the handle is in the unlocked position.

* * * * *